US012677864B2

(12) United States Patent
Wagner

(10) Patent No.: US 12,677,864 B2
(45) Date of Patent: Jul. 14, 2026

(54) KEYHOLE FILL PLATE FOR VERTICAL MULTI-TAMPING CIGARETTE HERB FILLING SYSTEM AND METHOD

(71) Applicant: Mitchell Aaron Wagner, Watsonville, CA (US)

(72) Inventor: Mitchell Aaron Wagner, Watsonville, CA (US)

( * ) Notice: Subject to any disclaimer, the term of this patent is extended or adjusted under 35 U.S.C. 154(b) by 487 days.

(21) Appl. No.: 18/311,183

(22) Filed: May 2, 2023

(65) Prior Publication Data

US 2023/0346005 A1 Nov. 2, 2023

Related U.S. Application Data

(60) Provisional application No. 63/337,492, filed on May 2, 2022.

(51) Int. Cl.
*A24C 5/06* (2006.01)
*A24C 5/39* (2006.01)

(52) U.S. Cl.
CPC ..... *A24C 5/06* (2013.01); *A24C 5/395* (2013.01)

(58) Field of Classification Search
None
See application file for complete search history.

(56) References Cited

U.S. PATENT DOCUMENTS

2019/0037911 A1* 2/2019 Wagner ..... A24D 1/18
2020/0054066 A1* 2/2020 Kaufmann ..... A24C 5/06
2020/0146336 A1* 5/2020 Lockwood ..... A24C 5/393
2021/0386628 A1* 12/2021 Jochemsen ..... A61J 7/0084

* cited by examiner

*Primary Examiner* — Michael H. Wilson
*Assistant Examiner* — Daniel Edward Vakili
(74) *Attorney, Agent, or Firm* — Cynthia S. Lamon; Lamon Patent Services

(57) ABSTRACT

An apparatus for making cigarettes has a plate on pegs holding paper rolls, a cover plate having second holes matching the holes in the holder plate, the cover plate engaging alignment pegs, a fill tray having third holes having a common diameter larger than the diameter of the second holes, the fill tray having keyhole corner openings engaging the alignment pegs allowing a range of lateral positions one of which is a closed position with no passage between the third holes in the fill tray and the second holes, and another being an open position with the third holes aligned with the second holes, such that moving the fill tray from the closed position to the open position allows the smoking material in the third holes to fall through the second holes in the cover plate into the paper rolls in the first holes of the holder plate.

11 Claims, 32 Drawing Sheets

KEYHOLE FILL PLATE FOR VERTICAL MULTI-TAMPING CIGARETTE HERB FILLING SYSTEM AND METHOD

CROSS-REFERENCE TO RELATED DOCUMENTS

The present application claims priority to provisional patent application 63/337,492 filed May 2, 2022, and all disclosure of the parent case is incorporated at least by reference.

BACKGROUND OF THE INVENTION

1. Field of the Invention

The present invention is in the technical field of apparatus for making cigarettes and relates more specifically to herb insertion systems and methods for introducing tobacco and other smoking materials into empty cigarette paper rolls.

2. Description of Related Art

Herb insertion machines such as those for inserting tobacco leaves and smoking herbs into empty cigarette paper rolls are becoming quite popular. One reason for this increased popularity is because finished products like cigarettes are expensive and have been taxed heavily in the recent past. It has become less expensive for users to fill their own empty paper cigarette tubes with loose tobacco or herbs.

However, existing herb insertion machines do not do an adequate job of ensuring that the smoking material or tobacco leaves are compact within cigarette paper rolls. This can cause large air spaces between the tobacco leaves causing inadequate burning of the smoking herbs and allows herbs to fall out; consequently, less pleasure is derived when the cigarette is used. Existing herb insertion machines also do not properly roll the cigarette paper rolls to have a finished look, and are limited to formats with a wider maximum diameter than 7 mm. It is difficult to fill cigarettes with a small diameter with larger enough particle sizes to allow proper air and smoke flow for a good user experience. Existing funnels and screw drives tend to clog.

BRIEF SUMMARY OF THE INVENTION

In an embodiment of the invention an apparatus for making cigarettes is provided, comprising a holder plate having a matrix of vertically oriented first holes adapted for holding cigarette paper rolls having a filter on a first end and open at a second end, the holder plate resting on lifter pegs on a support surface, such that a paper roll in a hole in the holder plate has the open end up and the filter end proximate the support surface, a cover plate substantially thinner than the holder plate, having a matrix of second holes matching the matrix of holes in the holder plate, the cover plate engaging alignment pegs in a top surface of the holder plate, aligning the matrix of second holes with the matrix of first holes, and a fill tray having a matrix of third holes matching the matrix of second holes in the cover plate, the third holes having a common diameter larger than the diameter of the second holes in the cover plate, the fill tray having a thickness greater than the thickness of the cover plate and two keyhole corner openings adapted to engage the alignment pegs of the holder plate in a manner allowing a range of lateral positions of the fill tray plate relative to the cover plate. The apparatus is characterized in that one of the lateral positions of the fill tray is a closed position with no passage between the third holes in the fill tray and the second holes in the cover plate, enabling a volume of smoking material determined by a diameter of the third holes and the thickness of the fill tray to be placed in the third holes, and in that another of the lateral positions is an open position with the third holes aligned with the second holes, wherein moving the fill tray having third holes filled with smoking material from the closed position to the open position allows the smoking material in the third holes to fall through the second holes in the cover plate into the paper rolls in the first holes of the holder plate.

In one embodiment the keyhole corner openings are on two corners of the fill tray diagonally opposite. Also, in one embodiment the open ends of the paper rolls have an inside diameter and the second holes of the cover plate have a diameter equal to the inside diameter of the open end of the paper rolls. In one embodiment the keyhole corner openings in the fill tray each comprise a round hole of a diameter greater than the diameter of the third holes in the filler plate, with a half round slot to one side that when firmly engaged to the alignment pegs places the filler plate in the closed position. And in one embodiment the filler plate is placed such that the alignment pegs are in any position other than engaged in the half round slot, there is at least a partial passage between the third holes in the filler plate and the second holes in the cover plate.

In one embodiment the apparatus further comprises a scoop for pouring smoking material onto the filler plate and into the third holes and a scraper for scraping excess smoking material from a top surface of the filler plate. Also, in one embodiment the apparatus further comprises a plurality of thin tipped tamper rods supported by stop bands in a matrix of openings in a set of plates in a first frame, the matrix of openings in the plates matching the matrix of second holes in the cover plate, in a manner that each thin-tipped tamper rod is loosely supported and separate from every other thin-tipped tamper rod, the first frame adapted to be positioned over the filler plate such that the thin-tipped tamper rods align with the third holes in the filler plate. Also, in one embodiment the apparatus further comprises a plurality of straight tamper rods supported by stop bands in a matrix of openings in a set of plates in a second frame, the matrix of openings in the plates matching the matrix of second holes in the cover plate, in a manner that each straight tamper rod is loosely supported and separate from every other straight tamper rod, the second frame adapted to be positioned over the filler plate such that the straight tamper rods align with the third holes in the filler plate.

In one embodiment the apparatus further comprises a plurality of burnishing rods supported in a matrix of openings in a set of plates in a third frame, the matrix of openings in the plates matching the matrix of second holes in the cover plate, in a manner that each burnishing rod is loosely supported and separate from every other burnishing rod, the third frame adapted to be positioned over the filler plate such that the burnishing rods align with the third holes in the filler plate, wherein the burnishing rods are driven by an electric motor. And in one embodiment the apparatus further comprises an ejector plate having a width and a length greater than the dimensions of the matrix of holes in the holder plate and less than the separation between the lifter pegs on the bottom of the holder plate, the ejector plate having a thickness substantially a length of the lifter pegs.

In another aspect of the invention a method for making cigarettes is provided comprising placing a holder plate having a matrix of vertically oriented first holes adapted for holding cigarette paper rolls having a filter on a first end and open at a second end on a support surface on lifter pegs, placing paper rolls in the holes in the holder plate such that the paper rolls in a hole in the holder plate have the open end up and the filter end proximate the support surface, placing a cover plate substantially thinner than the holder plate, the cover plate having a matrix of second holes matching the matrix of holes in the holder plate, over the holder plate engaging alignment pegs in a top surface of the holder plate, aligning the matrix of second holes with the matrix of first holes, placing a fill tray over the cover plate, the fill tray having a matrix of third holes matching the matrix of first holes in the holder plate, the third holes having a common diameter larger than the diameter of the second holes in the cover plate, the fill tray having a thickness greater than the thickness of the cover plate, and having two keyhole corner openings adapted to engage the alignment pegs of the holder plate in a manner allowing a range of lateral positions of the filler plate relative to the cover plate, over the cover plate, moving the fill tray to a closed position with no passage between the third holes in the filler plate and the second holes in the cover plate, pouring smoking material onto the fill tray and into the holes in the fill tray, scraping off excess smoking material, moving the fill tray to a position at least partially open allowing smoking material to fall into the paper rolls, positioning a first frame supporting thin-tipped tamper rods over the fill tray, aligning the thin-tipped tamper rods with the holes in the cover plate, lowering the first frame tamping the smoking material in the paper rolls, repeating the steps for filling moving the fill tray to a closed position with no passage between the third holes in the filler plate and the second holes in the cover plate, pouring smoking material onto the fill tray and into the holes in the fill tray, scraping off excess smoking material, moving the fill tray to a position at least partially open allowing smoking material to fall into the paper rolls, positioning the first frame supporting thin-tipped tamper rods over the fill tray, aligning the thin-tipped tamper rods with the holes in the cover plate, and lowering the first frame tamping the smoking material in the paper rolls, pouring smoking material onto fill tray in excess, positioning a second frame supporting straight tamper rods over the fill tray, aligning the straight tamper rods with the holes in the cover plate, lowering the second frame tamping the smoking material in the paper rolls, removing the cover plate, positioning the second frame supporting straight tamper rods over the fill tray, aligning the straight tamper rods with the holes in the cover plate, lowering the second frame tamping the smoking material in the paper rolls, positioning an assembly of motor-driven burnishing rods over the holder plate, lowering the assembly of burnishing rods to burnish ends of the smoking material in the paper rolls, and placing the fill tray over an ejection block, ejecting finished cigarettes from the holder plate.

BRIEF DESCRIPTION OF DRAWING FIGURES

FIGS. 16 C, D, E and F illustrate repeating the actions shown in FIGS. 8B, 9A, 9B, and 10A until the corner keyhole fill plate is emptied of smoking material.

Figure 17A:
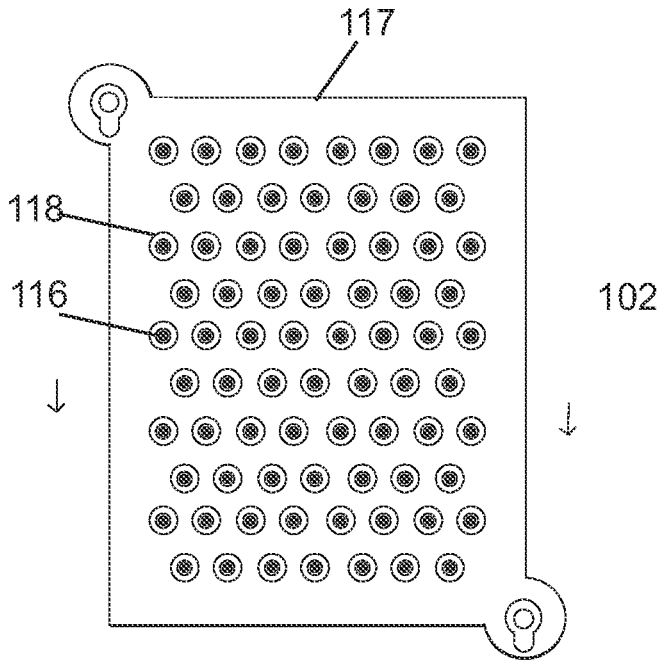

FIG. 17A is an overhead view illustrating movement of a corner keyhole fill tray back to center open position.

Figure 17B:
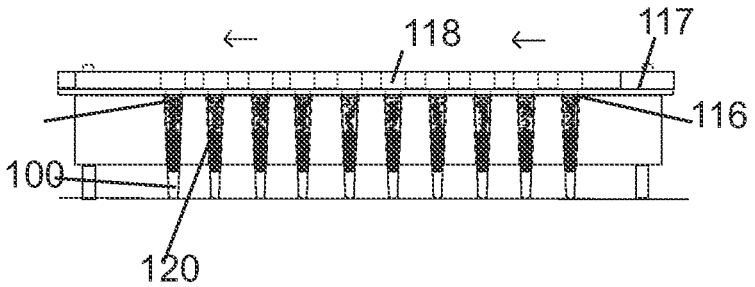

FIG. 17B is a side profile illustrating the movement of FIG. 17A.

Figure 17C:
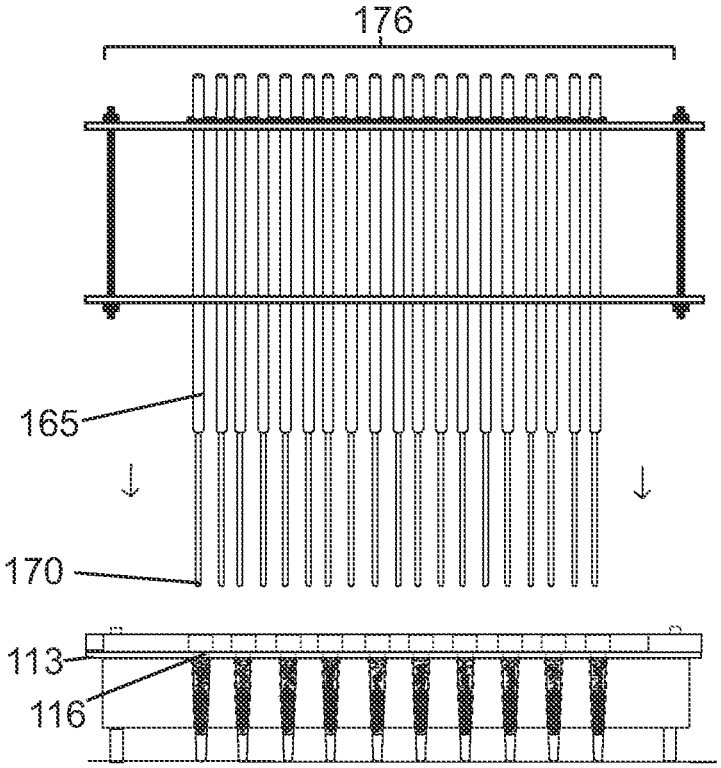

FIG. 17C illustrates the multi-tamper assembly aligned with openings in the cover plate according to an embodiment of the invention.

Figure 17D:
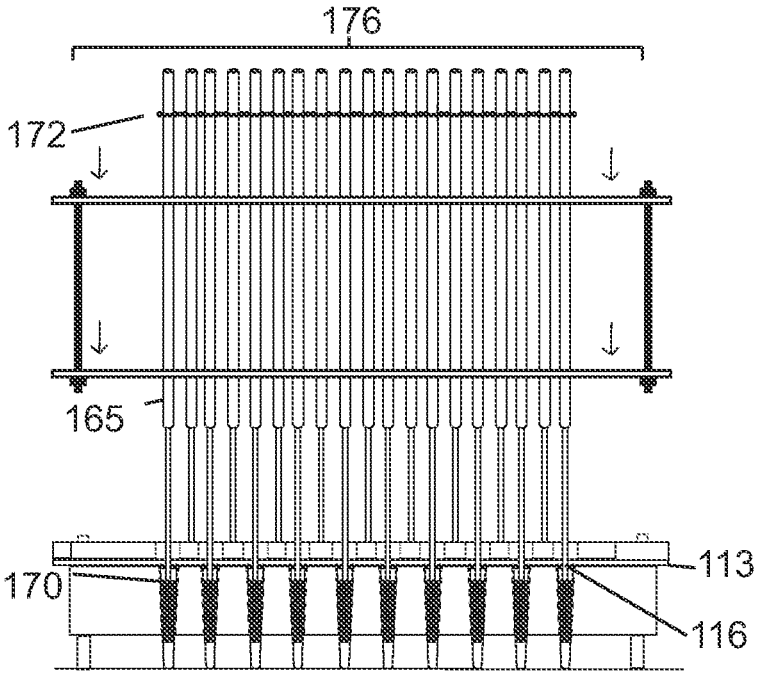

FIG. 17D is a side profile showing the assembly lowered from the position of FIG. 17C.

Figure 18A:
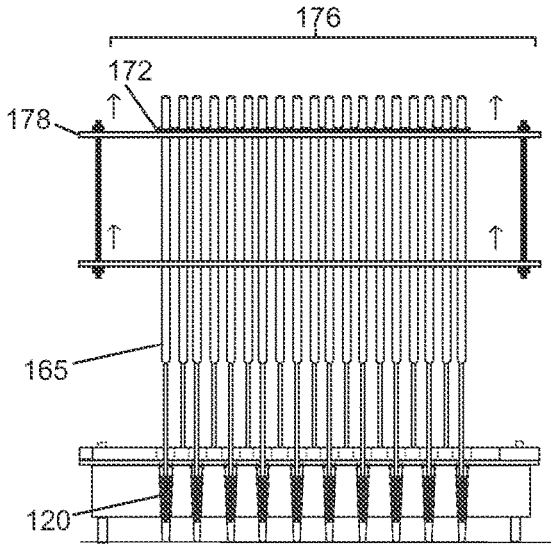

FIG. 18A illustrates lifting of the multi-tamper assembly upward.

Figure 18B:
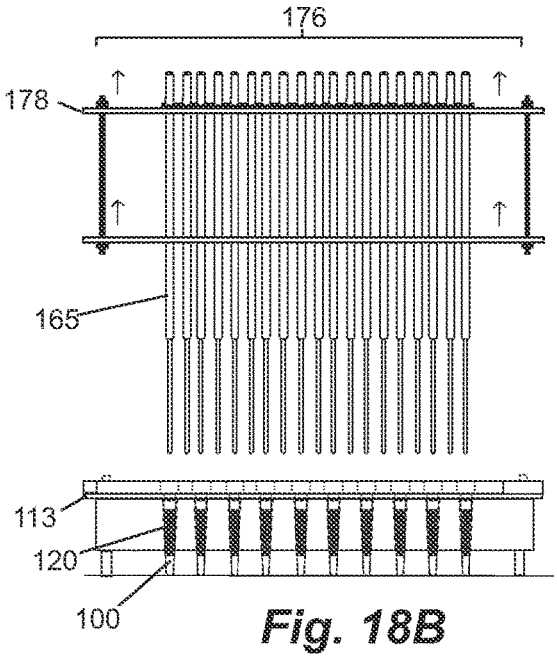

FIG. 18B illustrates the thin tamping tip rods clear of the corner keyhole fill tray holes.

Figure 18C:
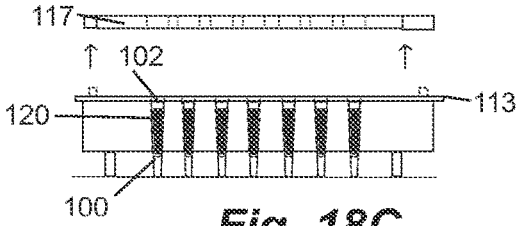

FIG. 18C is a front elevation illustrating removal of the corner keyhole fill tray from above the cover plate.

Figure 19A:
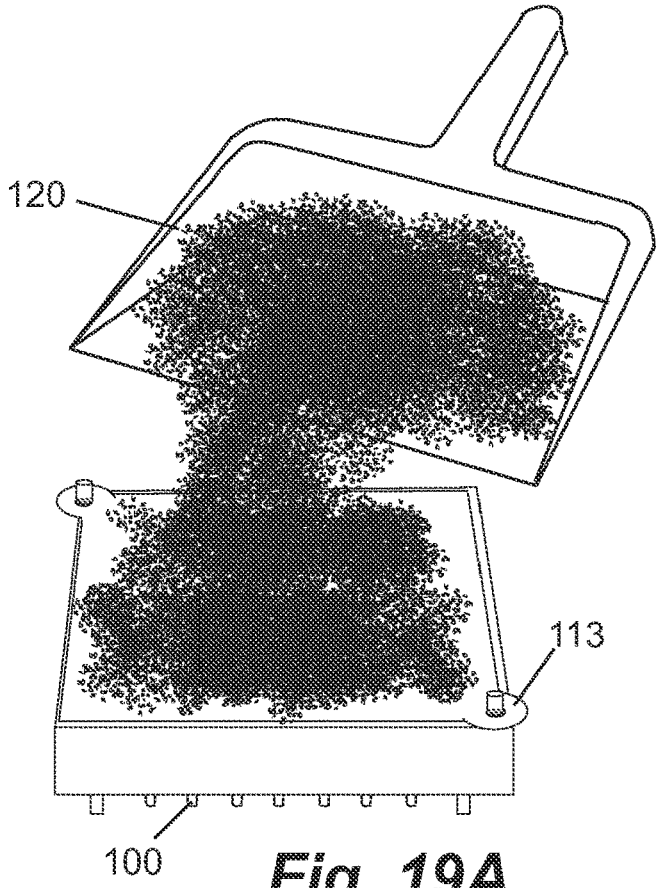

FIG. 19A is a perspective view illustrating smoking material poured directly into fill holes and into paper cigarette rolls.

Figure 19B:
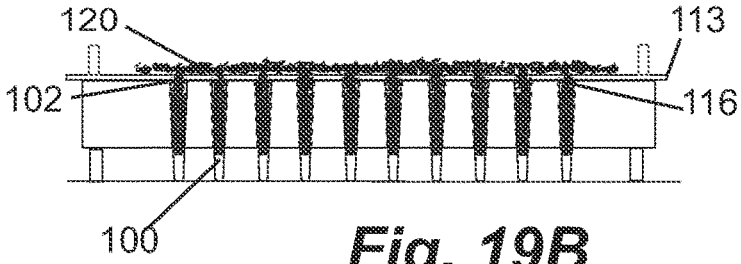

FIG. 19B is a side profile view of the operation of FIG. 19A.

Figure 19C:
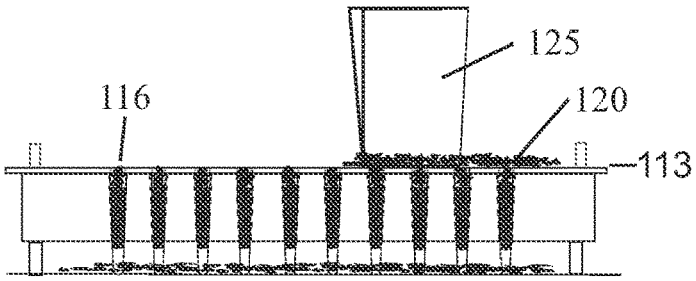

FIG. 19C illustrates a scraping tool removing excess smoking material from on the top of the cover plate.

Figure 20A:
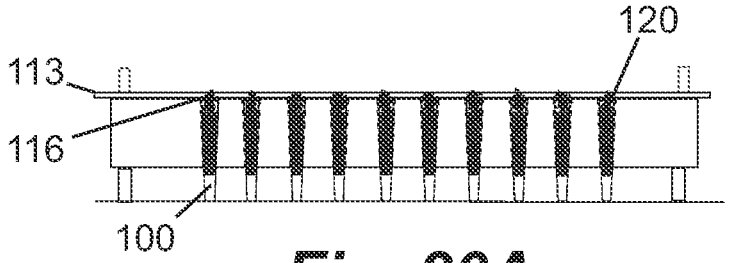

FIG. 20A is a side elevation view showing paper cigarette rolls mostly filled with compressed smoking material.

Figure 20B:
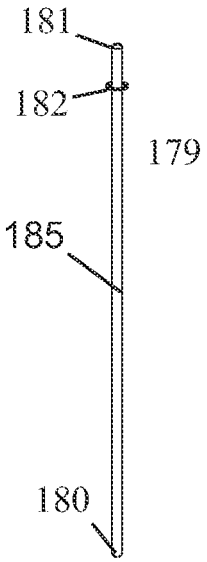

FIG. 20B shows a front elevation of a straight tamping rod.

Figure 20C:
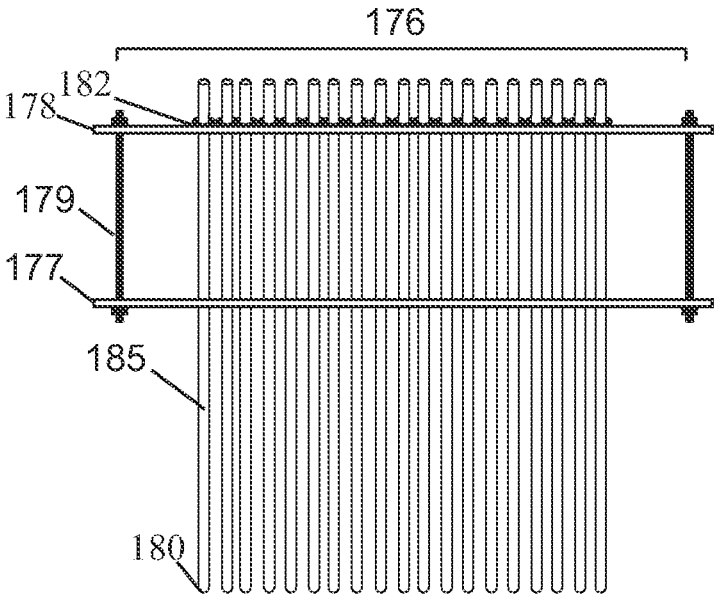

FIG. 20C is a side elevation showing straight tamping rods in a multi tamper frame.

Figure 21A:
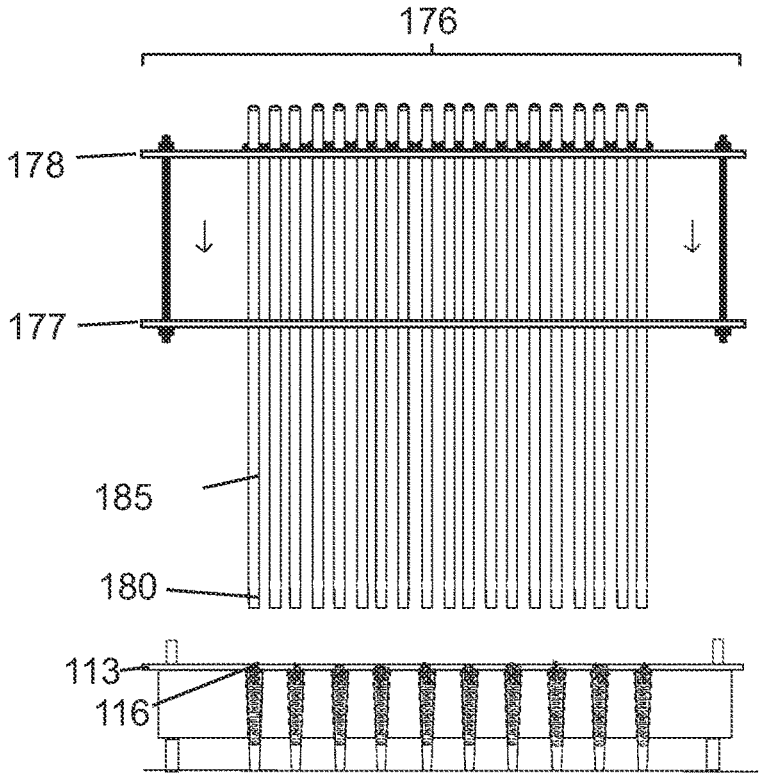

FIG. 21A is a side elevation of a multi-tamper assembly aligned with openings in the cover plate and uncompressed smoking material.

Figure 21B:
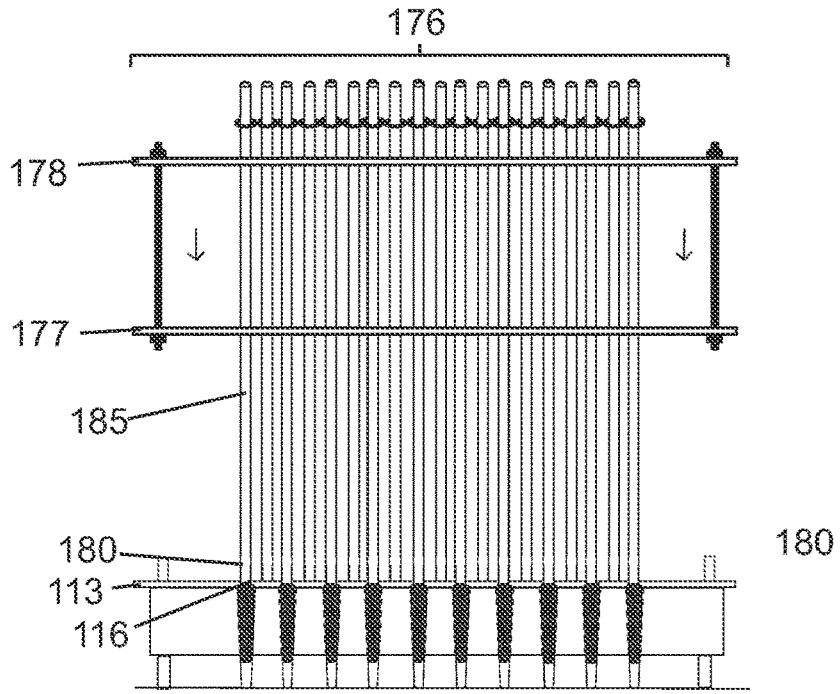

FIG. 21B is a side elevation illustrating lowering of the multi-tamper assembly until the weight of the straight tamping rods is transferred to the remaining uncompressed smoking material.

Figure 22A:
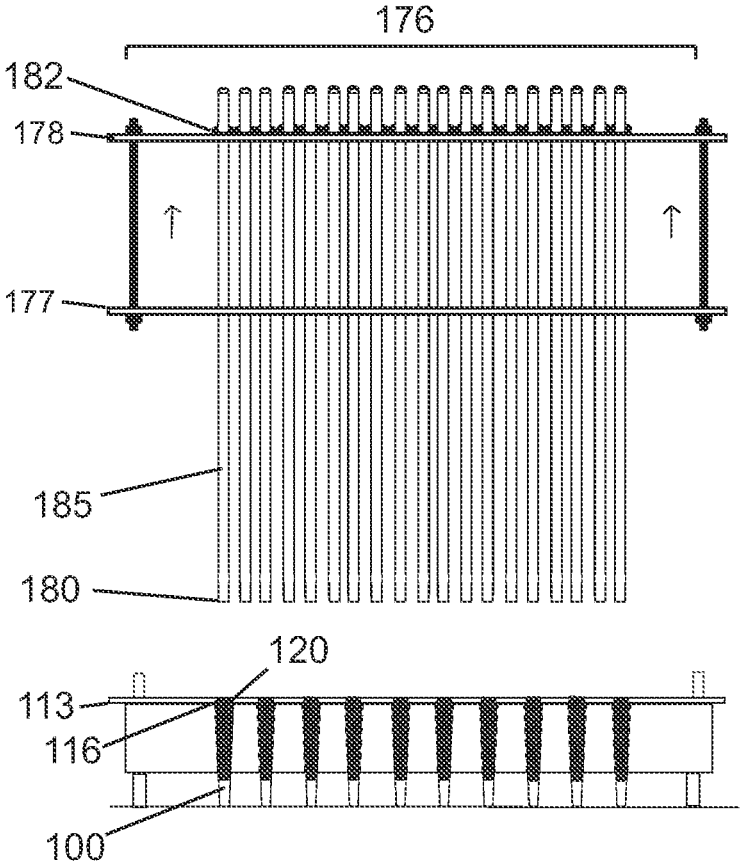

FIG. 22A is a side elevation showing lifting of the multi-tamper assembly upward until all straight tamping rods are clear.

Figure 22B:
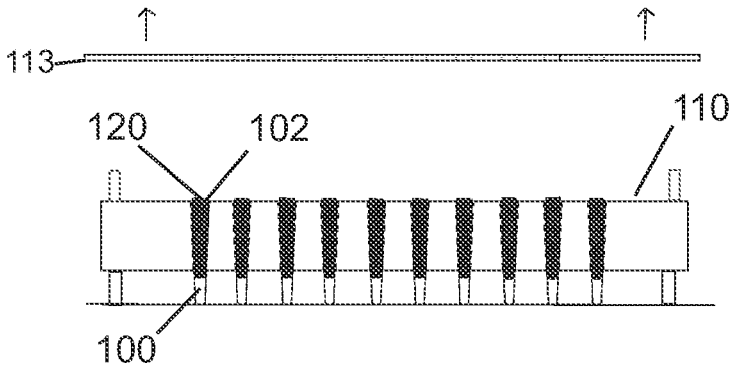

FIG. 22B is a side elevation of removal of the cover plate from the thick holder plate.

Figure 23A:
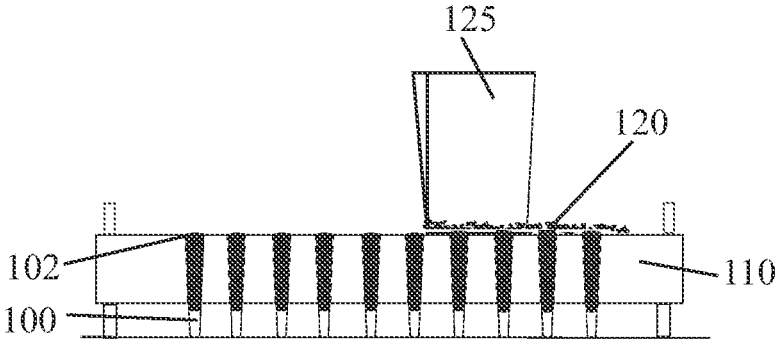

FIG. 23A is a side elevation of a scraping tool removing excess smoking material from on the top of the thick holder plate.

Figure 23B:
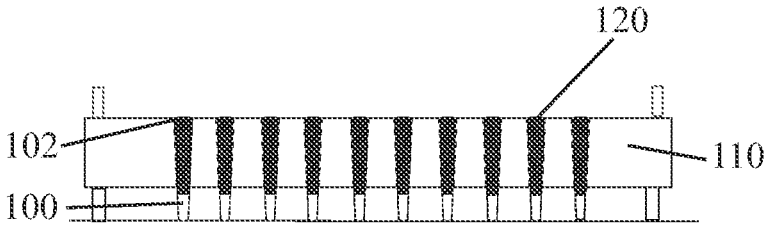

FIG. 23B is a side elevation showing the thick holder plate filled with cigarette paper rolls full of compressed smoking material.

Figure 24A:
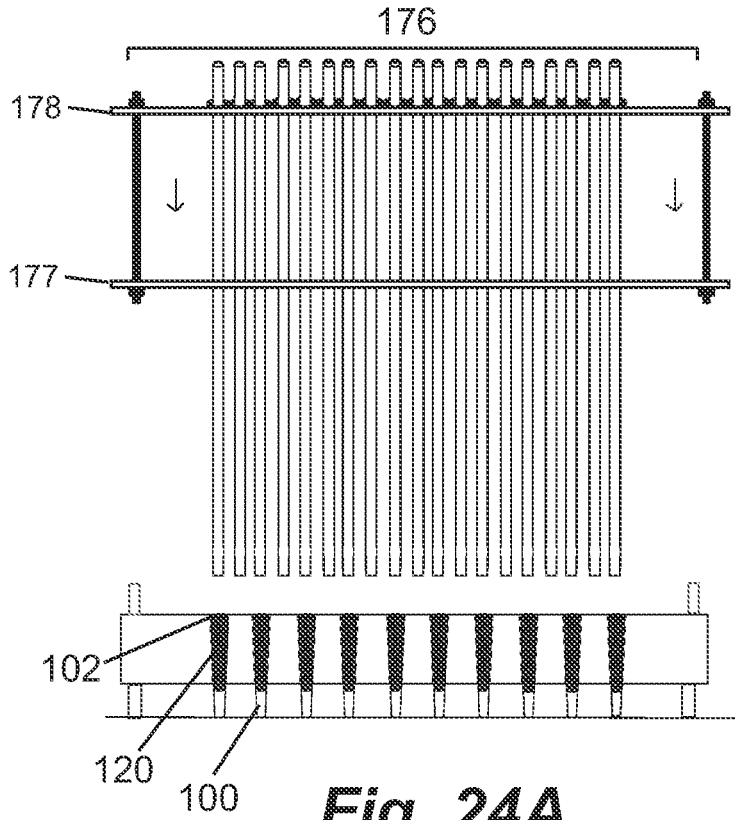

FIG. 24A is a side elevation illustrating the multi-tamper assembly aligned with the openings in the paper cigarette rolls and compressed smoking material.

Figure 24B:
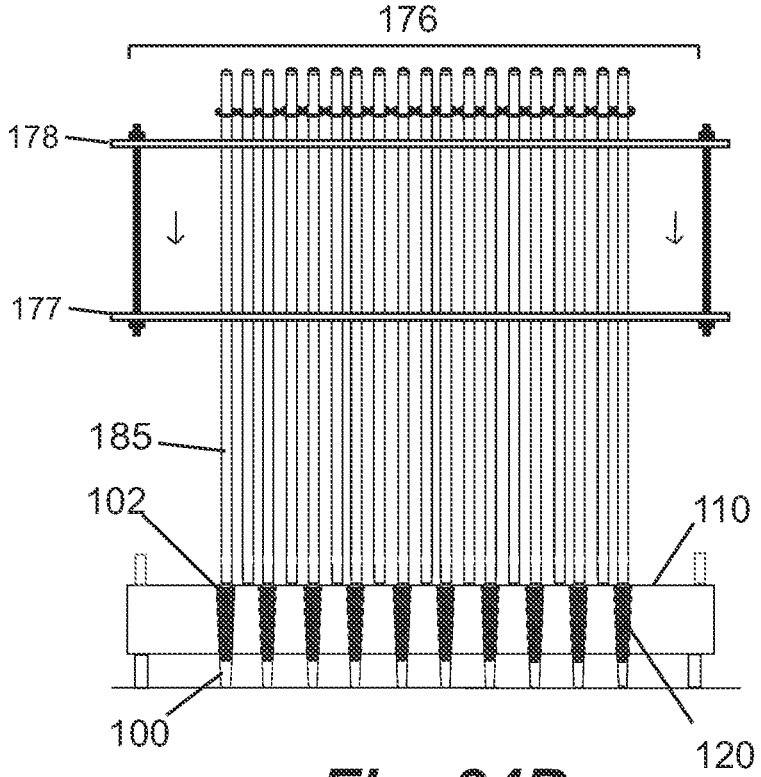

FIG. 24B is a side elevation illustrating lowering of the multi-tamper assembly until the weight of the straight rods is transferred to the compressed smoking material.

Figure 25A:
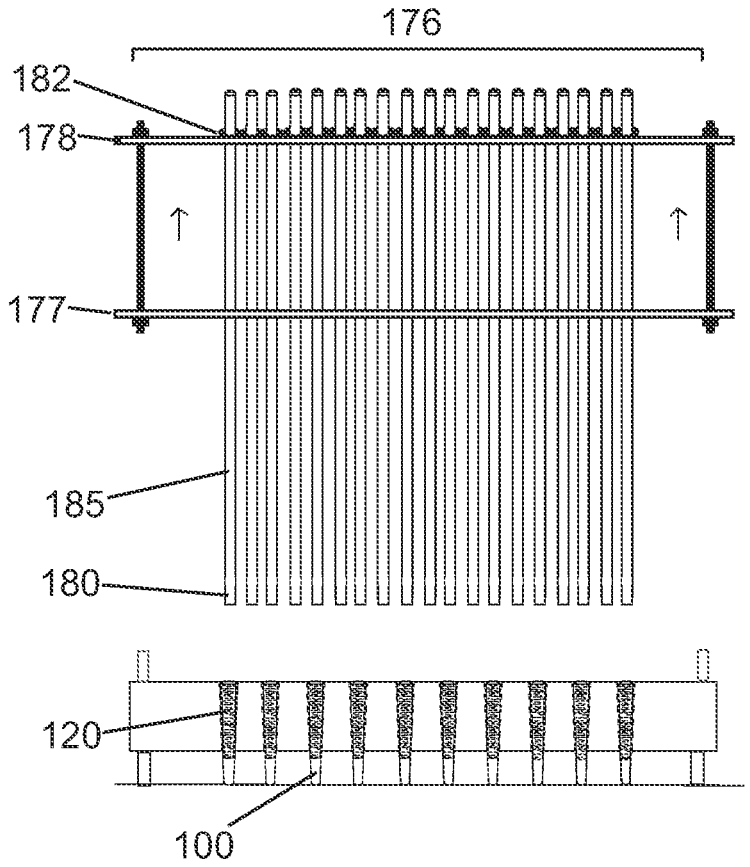

FIG. 25A is a side elevation illustrating lifting of the multi-tamper assembly upward until all straight tamping rods are clear.

Figure 25B:
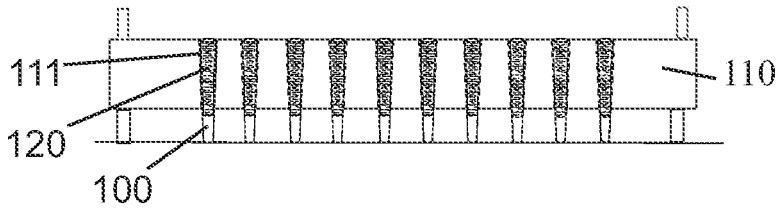

FIG. 25B is a side profile illustrating paper cigarette rolls completely filled with compressed smoking material inside the holder plate.

Figure 26A:
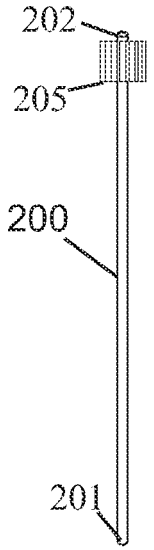

FIG. 26A illustrates a spinning burnishing rod in an embodiment of the invention.

Figure 26B:
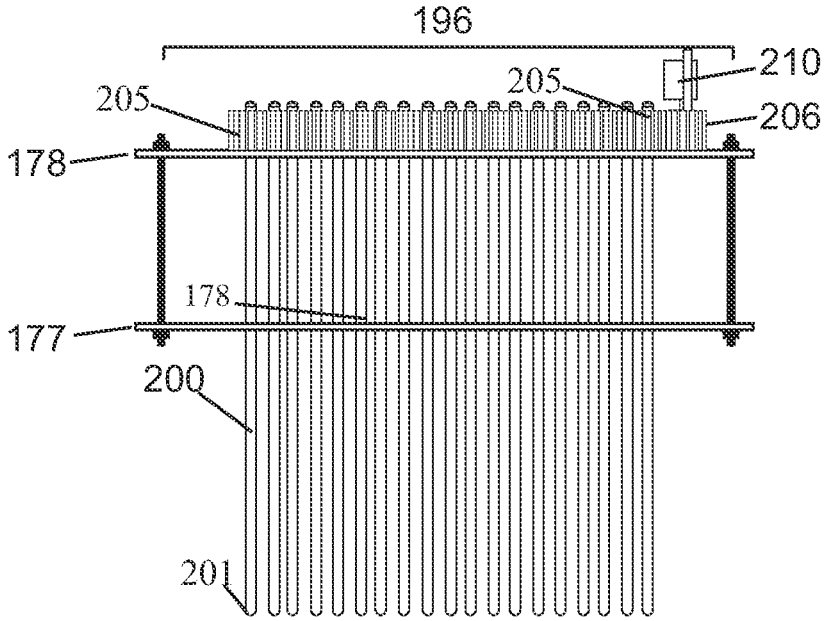

FIG. 26B is a side elevation illustrating spinning burnishing rods in a multi-tamper assembly creating a spinning rod assembly.

Figure 26C:
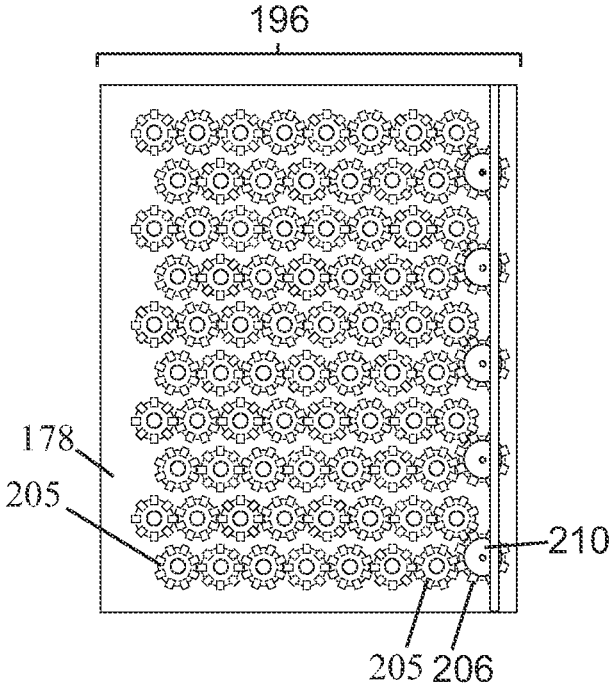

FIG. 26C is an overhead view of the spinning burnishing rod assembly of FIG. 26B.

Figures 27A, 27B, 27C:
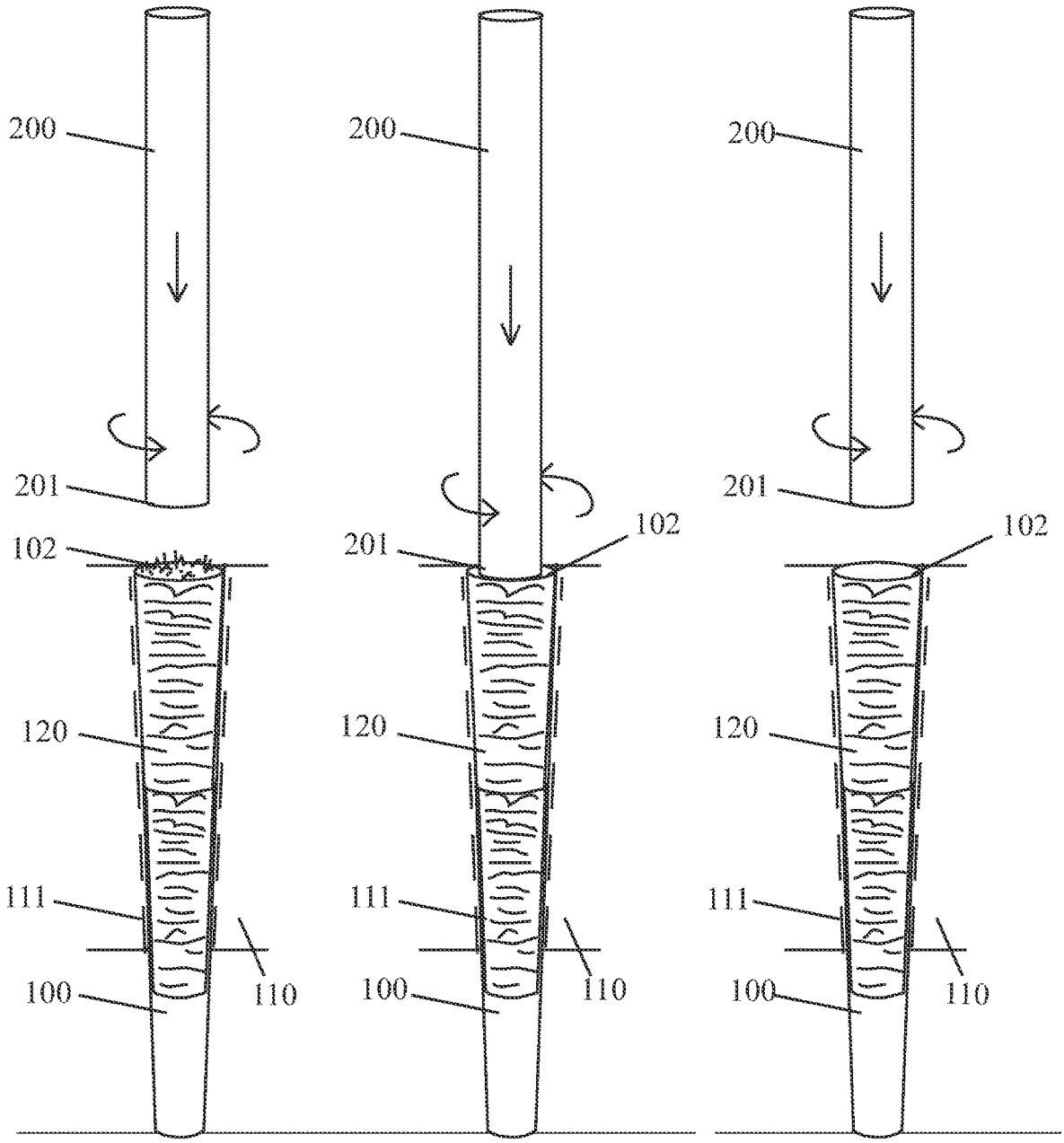

FIG. 27A is a side elevation illustrating an enlarged view of positioning of a flat surface at the bottom end of a spinning burnishing rod above an opening of a paper cigarette roll with an unburnished tip.

FIG. 27B illustrates pressing of the flat surface at the bottom end of spinning burnishing rod onto the opening at the top end of the paper cigarette roll.

FIG. 27C illustrates the flat surface of the bottom end of spinning burnishing rod being lifted away from the opening at the top end of the paper cigarette roll.

Figure 28A:
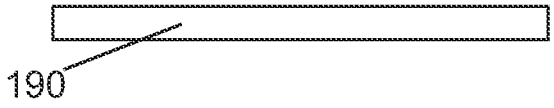

FIG. 28A is a side elevation of an ejection block according to an embodiment of the invention.

Figure 28B:
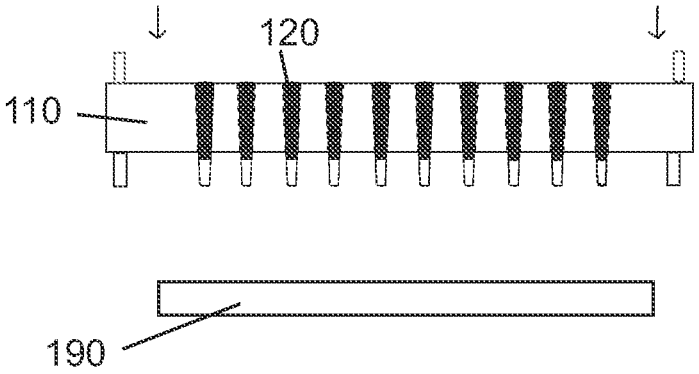

FIG. 28B illustrates positioning of the thick holder plate filled with paper cigarette rolls filled with compressed smoking material above the ejection block.

Figure 29A:
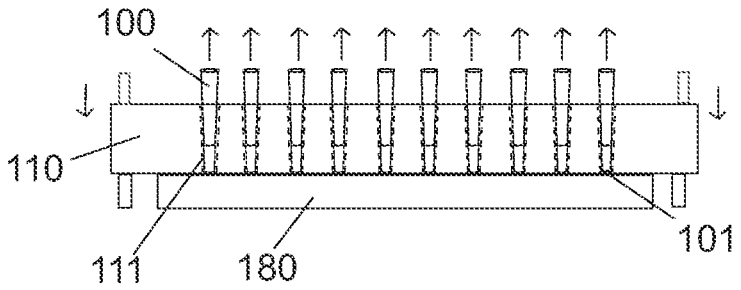

FIG. 29A is a side elevation illustrating the thick holder plate lowered onto the ejection block.

Figure 29B:
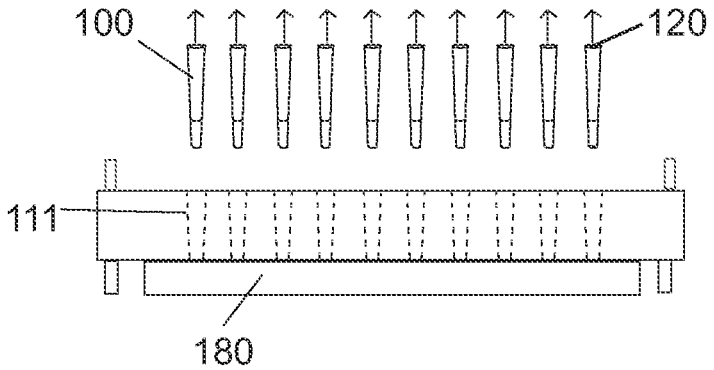

FIG. 29B illustrates removal of the completed paper cigarette rolls completely filled with compressed smoking material.

Figure 30:
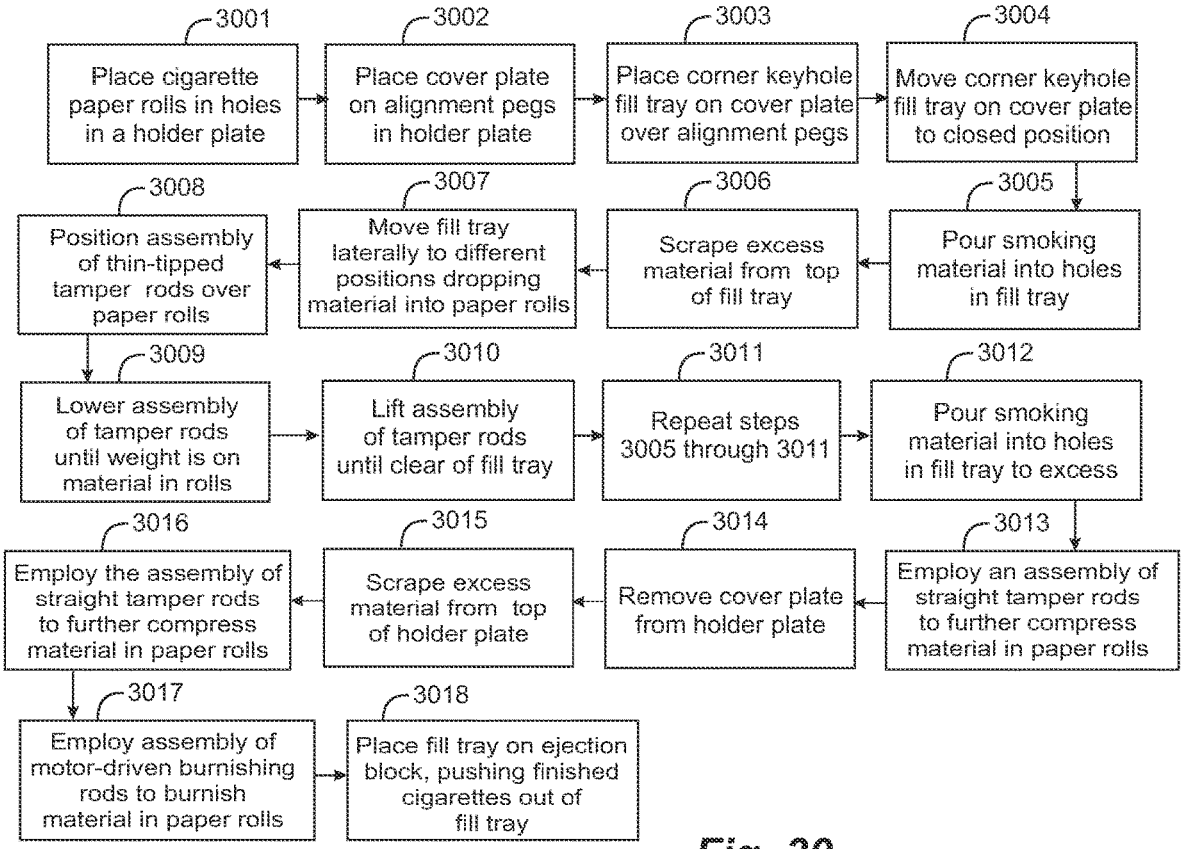

FIG. 30 is a flow diagram of a method of the invention.

DETAILED DESCRIPTION OF THE INVENTION

Various aspects of herb insertion systems and methods are illustrated and described below as exemplary embodiments of the present invention. The invented system includes a thick holder plate, where cigarette papers may be vertically inserted and held, pegs to elevate the height of the thick holder plate at a proper height, a cover plate to ease a filling and finishing process, a corner keyhole fill tray to allow larger particle size and volume dosing, pegs to align the cover plate and to guide the corner keyhole fill tray, a multi-tamper frame with independently weighted thin tip rods, used to compress smoking herbs inside of cigarette paper tubes, another multi-tamper frame filled with independently weighted straight rods, and another multi-tamper frame filled with spinning rods driven by gears and a motor used to burnish tips of completely filled cigarettes and an ejection block used to help remove the completed cigarettes.

Descriptions are provided below in detail to enable embodiments of the invention, with reference to accompanying drawings. While the invention is described in specific embodiments, it should be understood that the embodiments are exemplary and do not limit the invention to these embodiments. The invention is limited in scope only by the claims.

Figure 1A:
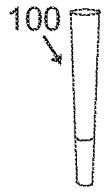
FIG. 1A is a front profile of an empty cigarette paper roll according to an embodiment of the present invention.
Figure 1B:
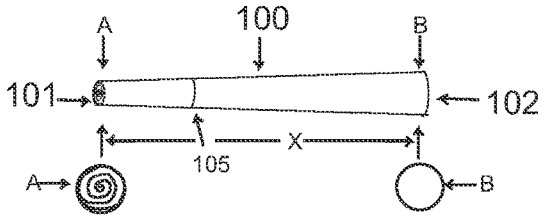
FIG. 1B is a side profile view of the empty cigarette paper roll of FIG. 1A.

FIG. 1A illustrates a cigarette paper roll 100 in front profile according to an exemplary embodiment of the invention. FIG. 1B shows paper roll 100 in a side profile view, and end views. Cigarette paper roll 100 is an elongated cylindrical or conical paper tube having two ends, namely distal end 101 and proximal opening 102. Distal end 101 includes a wound filter sometimes referred to as a crutch. Opening 102 is an open hole in the paper cylinder for holding compressed smoking material. Element number 105 represents the end of the filter crutch starting at end 101, and the beginning of the empty cylinder that ends at opening 102.

In FIG. 1A cross sectional diameter of filler tube 100 as shown at A is at least 3 to 9 millimeters. Cross section A also shows the wound paper crutch. Cross sectional diameter of filler tube 100 as shown at B is at least 4 to 9 millimeters also and shows an end of empty paper roll which smoking herbs will enter when inserted. Cigarette paper roll 100 is elongated, extending from proximal opening 102 to distal end 101. Length X between proximal opening 102 to distal end 101 is at least 50-70 millimeters. This length corresponds to the length of a cigarette. Cigarette paper roll 100 is preferably made of, but not limited to natural unbleached smoking paper.

Figure 1C:
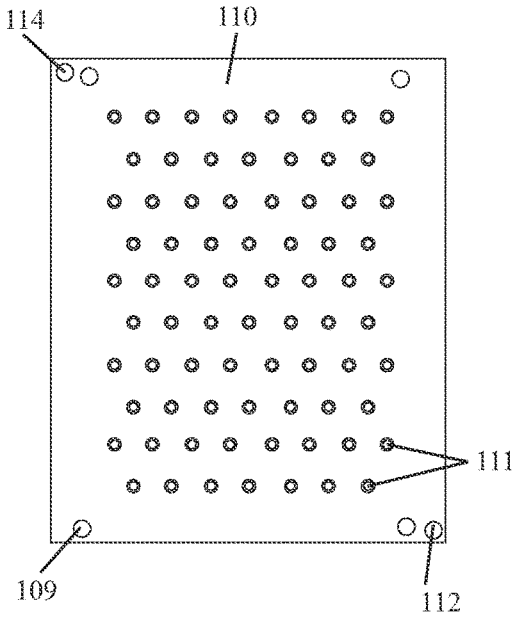
FIG. 1C is an overhead view of a thick holder plate and lifter pegs, along with alignment pegs. according to an embodiment of the present invention.
Figure 1D:
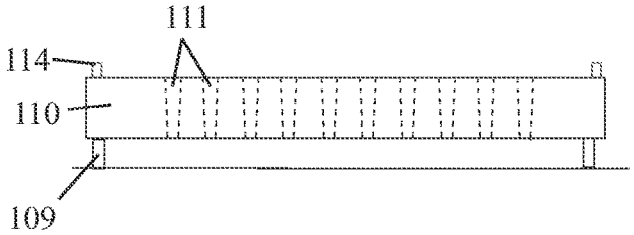
FIG. 1D is a profile view of the thick holder plate of FIG. 1C.

FIG. 1C is an overhead view of a thick holder plate 110 supported by lifter pegs 109 and with a matrix of holes 111 for use with cigarette paper rolls 100. FIG. 1D is a front profile of the thick holder plate. Cigarette paper rolls 100 may be inserted into holes 111. Also shown are alignment peg 114 operation of which is described in enabling detail below.

In FIG. 1C thick holder plate 110 may be used to insert distal end 101 of cigarette paper roll 100 first, leaving the proximal opening 102 of cigarette paper roll open and pointing up to allow smoking material to fall inside cigarette paper roll 100 down to the crutch end at 105. Thick holder plate 110 is preferably made of stainless steel, aluminum, wood, high density polyethylene or other suitable materials. The diameter of hole 111 is configured to be slightly larger than a perfect match to the diameter B of cigarette paper roll 100 so that cigarette paper roll 100 may be inserted tightly into hole 111 vertically to be filled with smoking material. Alignment pegs 112 and 114 are used to align a cover plate, not shown in FIG. 1C with the thick holder plate 110.

Figure 2A:
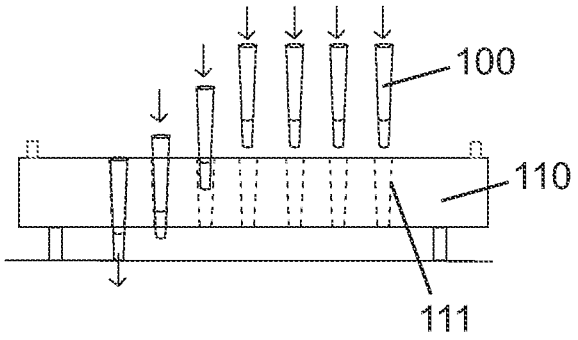
FIG. 2A is a front profile illustrating insertion of empty cigarette paper rolls into the thick holder plate in an embodiment of the present invention.
Figure 2B:
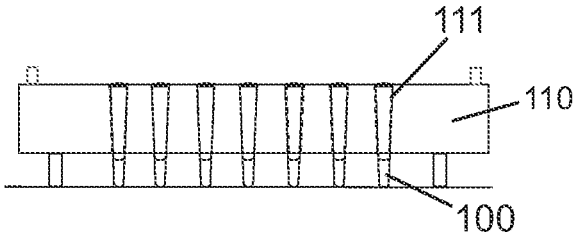
FIG. 2B is a front profile view showing cigarette paper rolls fully loaded into the thick holder plate.

FIG. 2A illustrates insertion of cigarette paper rolls 100 into holes 111 of thick holder plate 110. The operation is repeated until the holes 111 in thick holder plate 110 are filled with cigarette paper rolls 100. FIG. 2B illustrates cigarette paper rolls 100 fully inserted into holes 111 of thick holder plate 110. At this point thick holder plate 110 is filled with cigarette paper rolls.

Figure 3A:
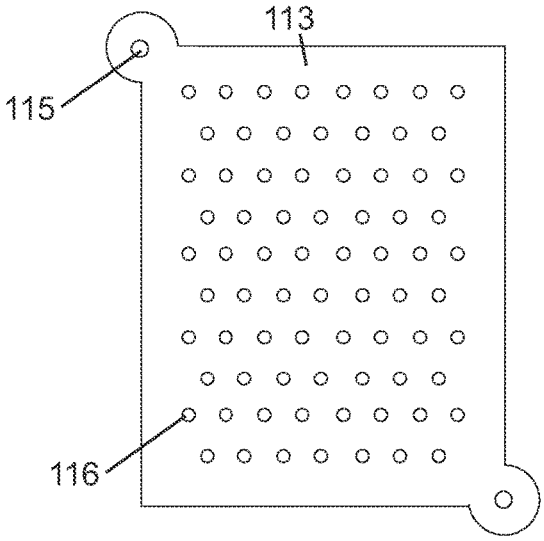
FIG. 3A is an overhead view of a cover plate according to an embodiment of the invention.
Figure 3B:
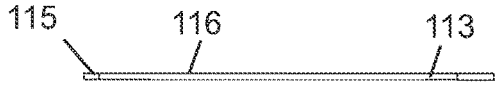
FIG. 3B is a side view of the cover plate.

FIG. 3A Illustrates a cover plate 113 used with thick holder plate 110. Cover plate 113 has a matrix of holes 116 that are slightly smaller than the top openings of holes 111 in thick holder plate 110. Holes 116 are used to cover the outside diameter edge of the holes 111 in thick holder plate 110, thus covering the outside diameter of each distal end 102 of cigarette paper roll 100 inserted into holder plate 110. This circumstance allows extra smoking material to be added on top of each distal end 102 without hitting the top end of paper cigarette rolls. Cover plate 113 also has alignment holes 115. FIG. 3B is a front profile view of the cover plate.

Figure 3C:
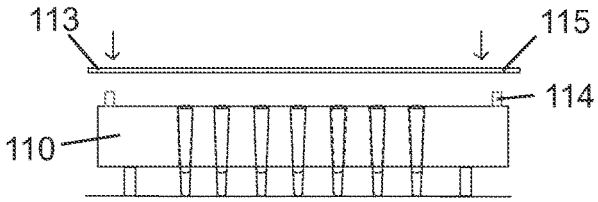
FIG. 3C illustrates alignment and placement of a cover plate over alignment pegs onto a fully loaded thick holder plate in an embodiment of the present invention.
Figure 3D:
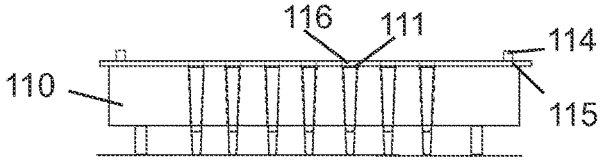
FIG. 3D is a side showing the cover plate in place.

FIG. 3C is a front elevation view of thick holder plate 110 with alignment pegs 114, with cover plate 113 positioned over the holder plate. FIG. 3D illustrates cover plate 113 engaged with holder plate 110 by alignment pegs 114 through alignment holes 115, aligning the cover plate 113 with the thick holder plate 110. At this point the outside diameter B of each distal end 102 of cigarette paper rolls 100 is covered by the cover plate 114.

Figure 4A:
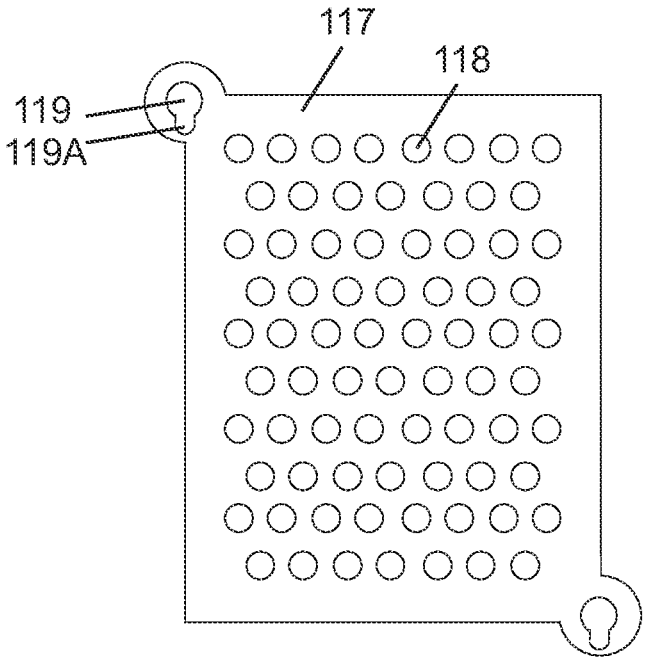
FIG. 4A is an overhead view of a corner keyhole fill tray in an embodiment of the invention.
Figure 4B:
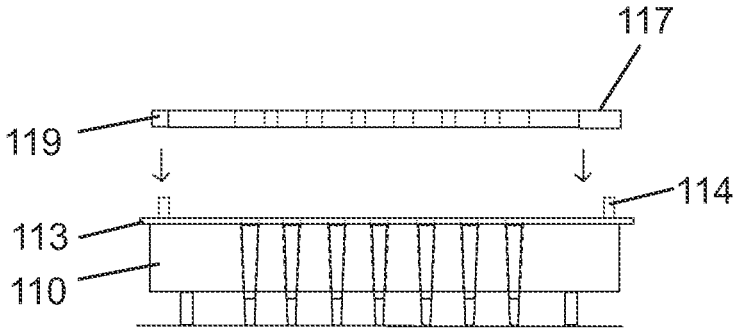
FIG. 4B is a front profile view of alignment and placement of a corner keyhole fill tray over alignment pegs onto a cover plate in an embodiment of the invention.

FIG. 4A illustrates corner keyhole fill tray 117 with oversized holes 118, larger in diameter than holes 116 in the cover plate, which allows addition of more smoking material than smaller hole sizes would allow, and also allows use of smoking material with larger particle sizes. Keyhole fill tray 117 has corner holes 119 that are larger in diameter than alignment pegs 114, and also have a circular side cutout 119A. FIG. 4B illustrates corner keyhole fill tray 117 positioned to be lowered onto cover plate 113, with keyhole corner holes 119 aligned to engage pegs 114. Fill tray 117 is adapted to enable filling of paper rolls held in holder plate 110 with smoking material. Fill tray 117, once positioned over pegs 114 may be moved laterally in any direction, constrained by the diameter of holes 119, allowing movement of corner keyhole fill tray 117 in a circular or multi directional lateral motion to agitate smoking material in holes 118 until the smoking material falls through holes 116 in cover plate 113 into the paper rolls. This feature is especially useful when making cigarettes with a small diameter. Cutout 119A has the same diameter as pegs 114, so when shifted to have pegs 114 engaged with cutouts 119A there is a tight fit. When in this position, holes 118 stop on a flat blank area of the cover plate 113, hiding cover plate holes 116 and proximal end of paper cigarette roll 102.

In the process of measuring smoking material for insertion to the paper rolls, the keyhole fill tray is positioned with cutouts 119A engaging pegs 114 to close the passage to the paper rolls. At this position smoking material may be properly measured into oversized holes 118 before being passed into cigarette paper rolls 100. The amount of smoking material that may be passed into the paper rolls may also be varies by changing the thickness of keyhole fill tray 117.

Figure 5A:
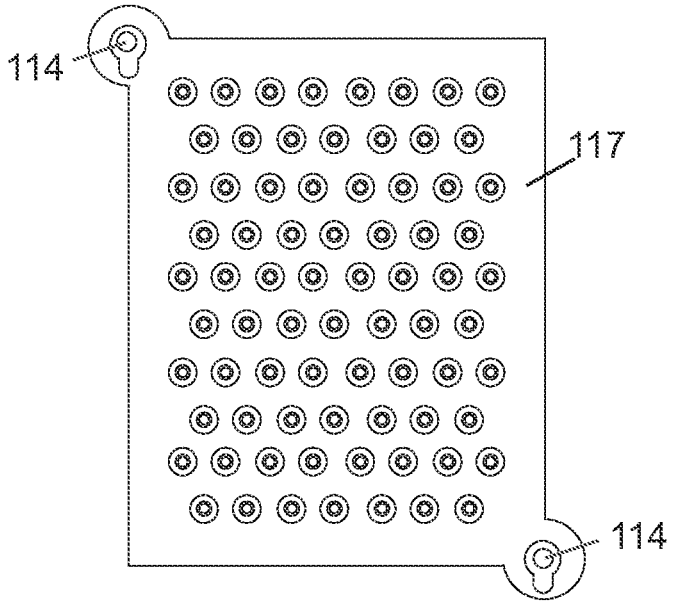
FIG. 5A is a side elevation view of placement of a corner keyhole fill tray over alignment pegs onto a cover plate.
Figure 5B:
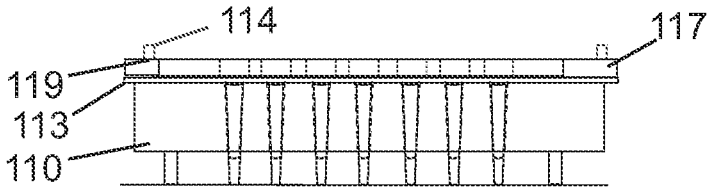
FIG. 5B is an overhead view of the placement of FIG. 5A.
Figure 5C:
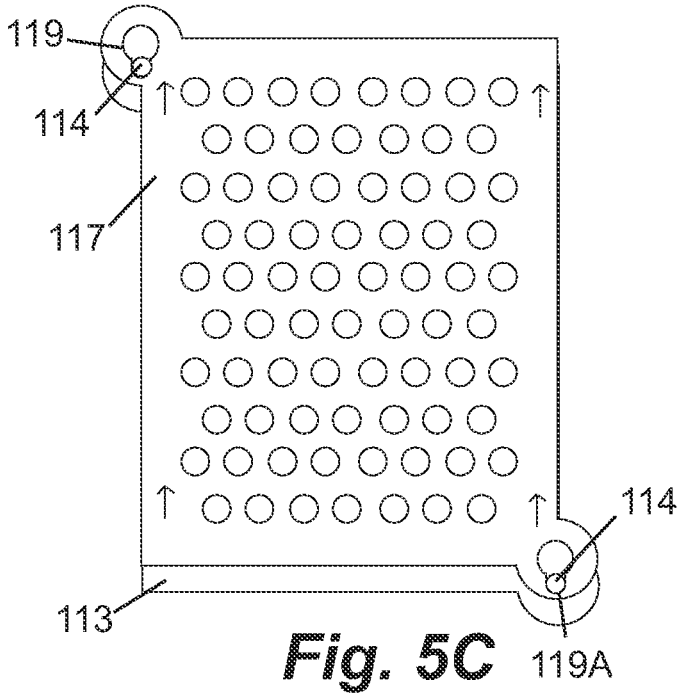
FIG. 5C is an overhead view illustrating movement of a corner keyhole fill tray to closed position against alignment pegs.

FIG. 5A illustrates center placement of corner keyhole fill tray 117 over alignment pegs 114. FIG. 5B is a side view. FIG. 5C shows the fill tray shifted to the closed position with cutouts 119A tightly engaged to pegs 114. In this position holes 118 are above flat blank areas of cover plate 113, hiding cover plate holes 116 and proximal end of paper cigarette roll 102. In this position oversized holes 118 are now ready to fill with smoking material.

Figure 6A:
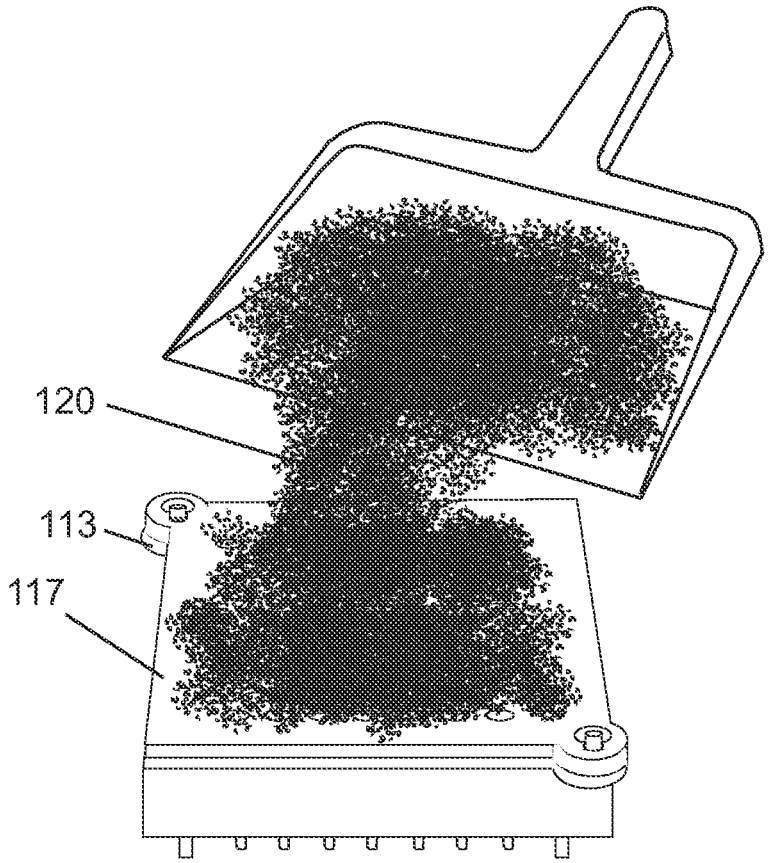
FIG. 6A is a perspective view of a scoop pouring milled smoking material onto a fill tray in an embodiment of the invention.
Figure 6B:
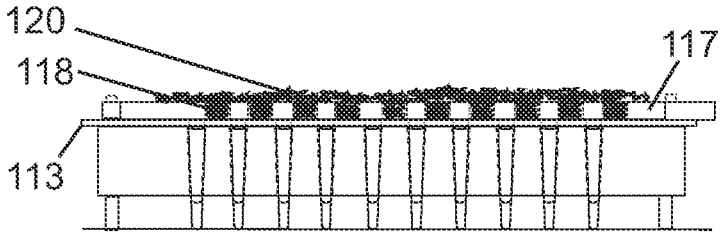
FIG. 6B is a side view of the fill tray in place with smoking material on top.

FIG. 6A illustrates milled smoking material 120 being poured onto fill tray 117 from a scoop. FIG. 6B is a side elevation view showing holes 118 in fill tray 117 full and overflowing with milled smoking material.

Figure 7A:
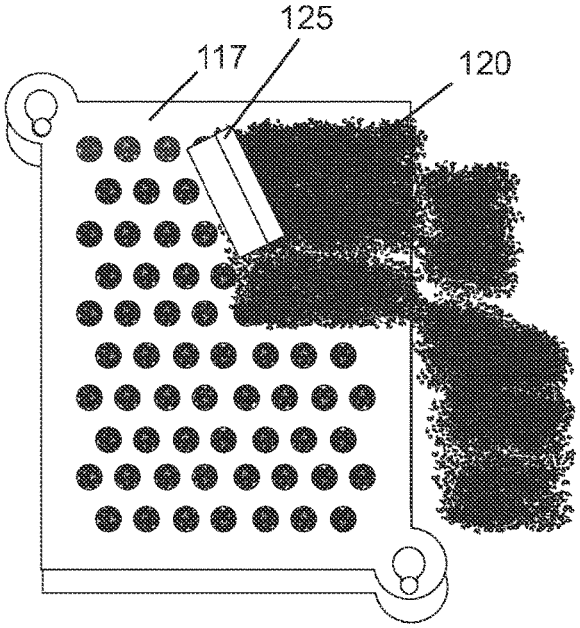
FIG. 7A is an overhead view showing a scraping tool removing excess smoking material.
Figure 7B:
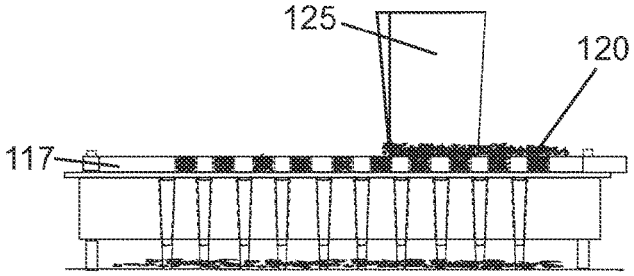
FIG. 7B is a side profile view of the operation of FIG. 7A.
Figure 7C:
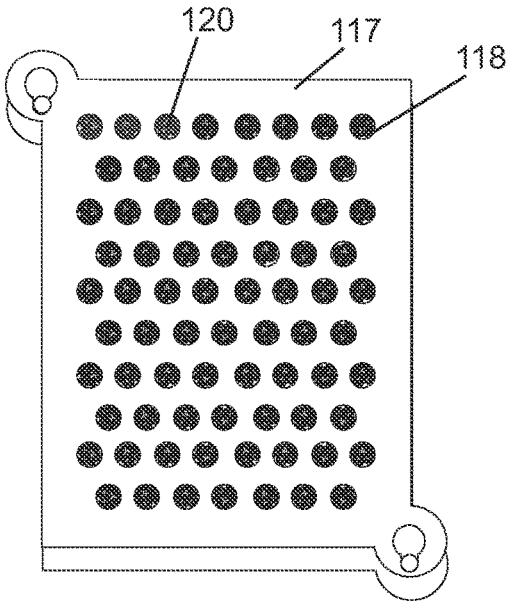
FIG. 7C is an overhead view showing smoking material filled into the holes of the corner keyhole fill tray.
Figure 7D:
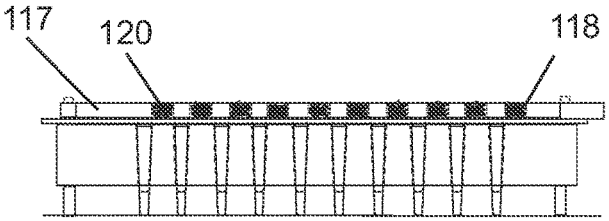
FIG. 7D is a side view showing smoking material filled into the holes of the corner keyhole fill tray.

FIG. 7A illustrates a flat scraping tool 125 being used to remove excess smoking material 120 from corner keyhole fill tray 117, that hasn't fallen into oversized holes 118. FIG. 7B is a side profile view of the scraping operation. FIG. 7C is an overhead view showing oversized holes 118 completely filled with smoking material 120 and the top surface of corner keyhole fill tray 117 clean of excess smoking material 120. FIG. 7D is a side elevation view showing holes 118 filled to the top.

Figure 8A:
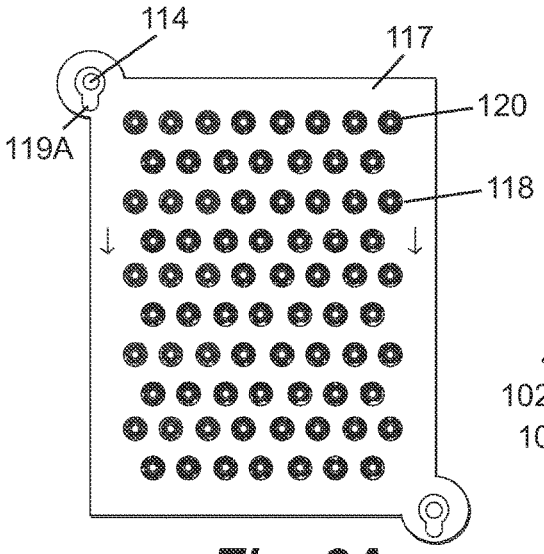
FIG. 8A is an overhead view illustrating movement of a corner keyhole fill tray to a center open position.
Figure 8B:
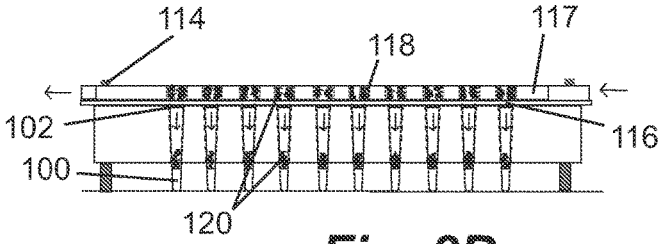
FIG. 8B is a side profile view of the movement of FIG. 8A.

FIG. 8A illustrates movement of corner keyhole fill tray 117 to the center open position disengaging pegs 114 from cutouts 119A. This center open position allows some smoking material 120 to fall from the oversized holes 118 in corner keyhole fill tray 117 through the cover plate holes 116 into the opening in proximal end 102 of the cigarette paper rolls 100 held in holder plate 110. FIG. 8B is a side elevation view.

Figure 8C:
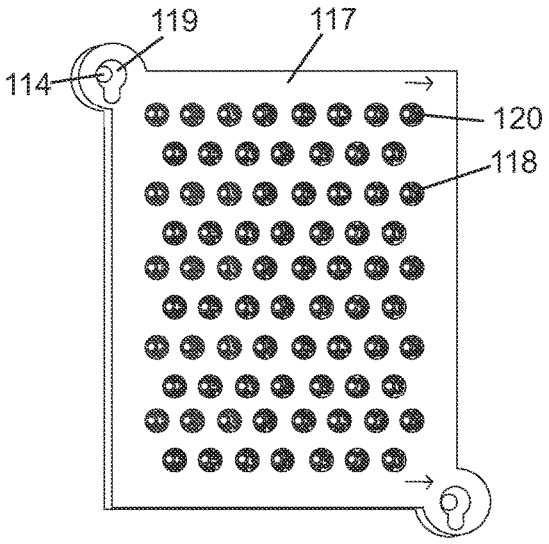
FIG. 8C is an overhead view illustrating movement of a corner keyhole fill tray to a right open position.
Figure 8D:
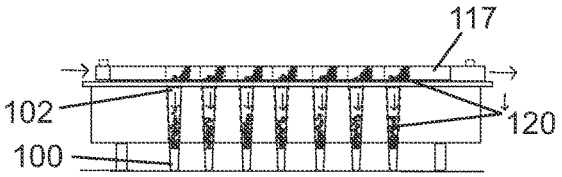
FIG. 8D is a front elevation view illustrating the movement of FIG. 8D.

FIG. 8C illustrates movement of corner keyhole fill tray 117 until the sides of keyholes 119 hit pegs 114 placing the fill tray in the directional open position. This position allows some more smoking material 120 to fall from the oversized hole 118 in corner keyhole fill tray 117 through the cover plate holes 116 into the opening in proximal end 102 of the cigarette paper roll 100. FIG. 8D is a front elevation view.

Figure 9A:
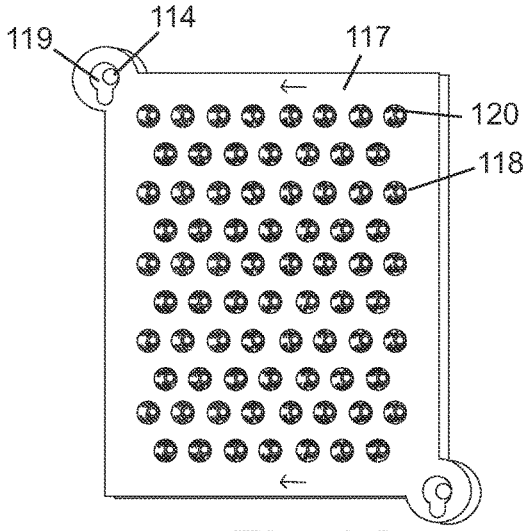
FIG. 9A is an overhead view illustrating movement of a corner keyhole fill tray to a left open position.
Figure 9B:
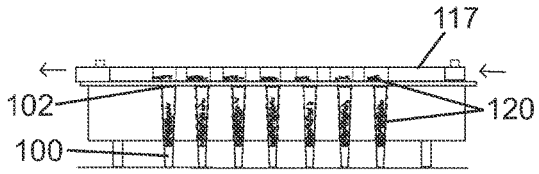
FIG. 9B is a front elevation view of the movement of FIG. 9A.

FIG. 9A illustrates movement of a corner keyhole fill tray 117 until the side of keyholes 119 hits pegs 114 in the left directional open position. This position allows some more smoking material 120 to fall from the oversized hole 118 in corner keyhole fill tray 117 through the cover plate holes 116 into the opening in proximal end 102 of the cigarette paper roll 100. FIG. 9B is a front elevation view.

Figure 9C:
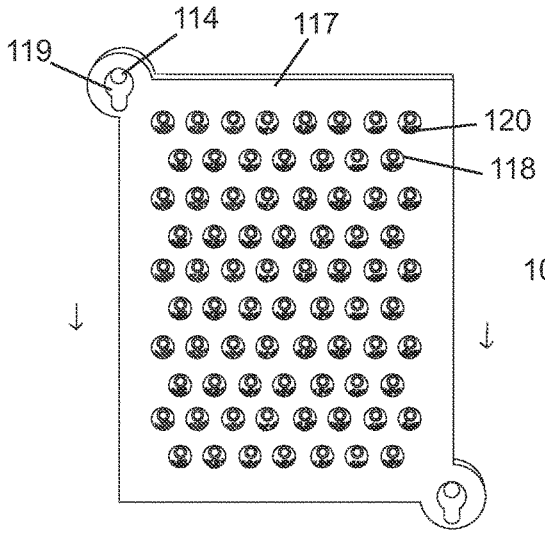
FIG. 9C is an overhead view illustrating movement of a corner keyhole fill tray to a right open position.
Figure 9D:
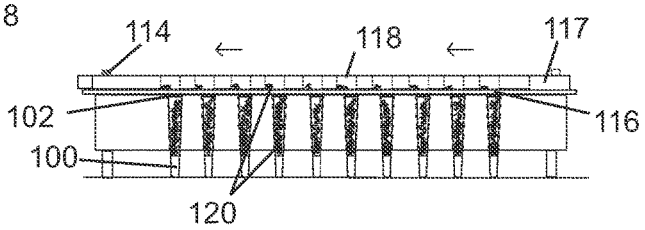
FIG. 9D is a side elevation view illustrating the movement of FIG. 9D.

FIG. 9C illustrates movement of a corner keyhole fill tray 117 until the side of keyholes 119 hits pegs 114 in the forward directional open position. This position allows yet more smoking material 120 to fall from the oversized hole 118 in corner keyhole fill tray 117 through the cover plate holes 116 into the opening in proximal end 102 of the cigarette paper roll 100. FIG. 9D is a side elevation view of this operation.

Figure 10A:
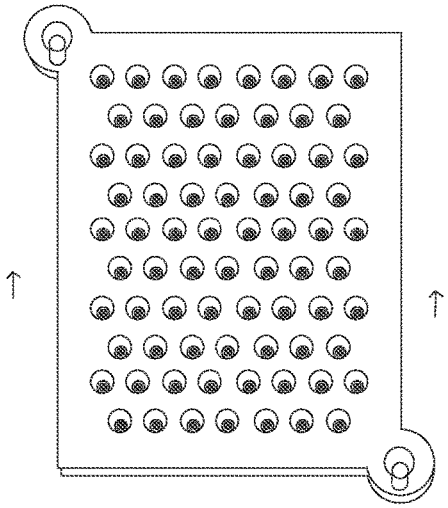
FIG. 10A is an overhead view illustrating movement of a corner keyhole fill tray to a back open position.
Figure 10B:
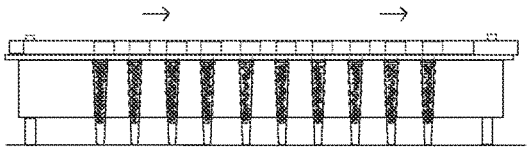
FIG. 10B is a side elevation view of the movement of FIG. 10A.

FIG. 10A illustrates movement of a corner keyhole fill tray 117 until the pegs 114 almost enters cutout 119A placing the fill tray in back directional open position. This position causes remaining smoking material 120 to fall from the oversized holes 118 in corner keyhole fill tray 117 through the holes 116 in cover plate 113 into the opening in proximal end 102 of the cigarette paper roll 100. FIG. 10B is a side profile view.

Figure 10C:
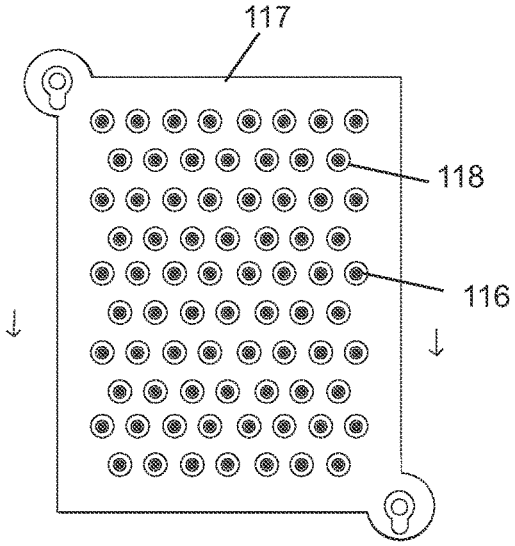
FIG. 10C is an overhead view illustrating movement of a corner keyhole fill tray to a center open position.
Figure 10D:
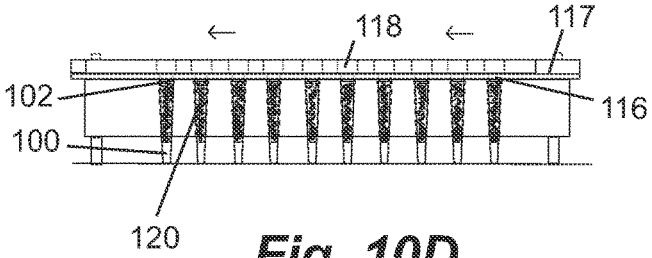
FIG. 10D is a side elevation view illustrating the movement of FIG. 10C.

FIG. 10C illustrates movement of a corner keyhole fill tray 117 back to the center open position completely exposing cover plate holes 116 into the openings in proximal opening of ends 102 of the cigarette paper rolls 100. In this centered position, the smoking material 120 in the paper rolls is ready to be compressed. FIG. 10D is a side profile view.

Figure 11A:
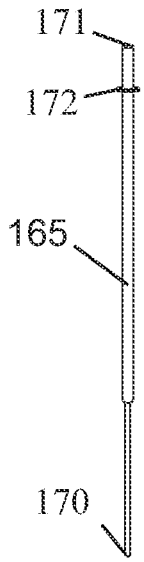
FIG. 11A illustrates a thin tip tamping rod in an embodiment of the invention.

FIG. 11A illustrates a thin tipped tamper rod 165 according to an embodiment of the invention. The thin tipped tamper rod may be used to compress smoking material 120 or the like inside cigarette paper rolls 100. Thin tipped tamper rod 165 in this example is a solid elongated cylindrical steel tubing having closed ends, namely distal end 170 and proximal end 171. Distal end 170 includes a thinner flat end used to compress smoking herbs 120. The thin tips at distal end 170 have an ability to compress smoking material 120 inside cigarette paper rolls that have a small diameter. Proximal end 171 includes a stop band 172 of a larger diameter than the cylinder. Stop band 172 is used to stop tamper rod 165 from sliding all the way through the holes in a tamper frame 176 illustrated in FIG. 11B.

Figure 11B:
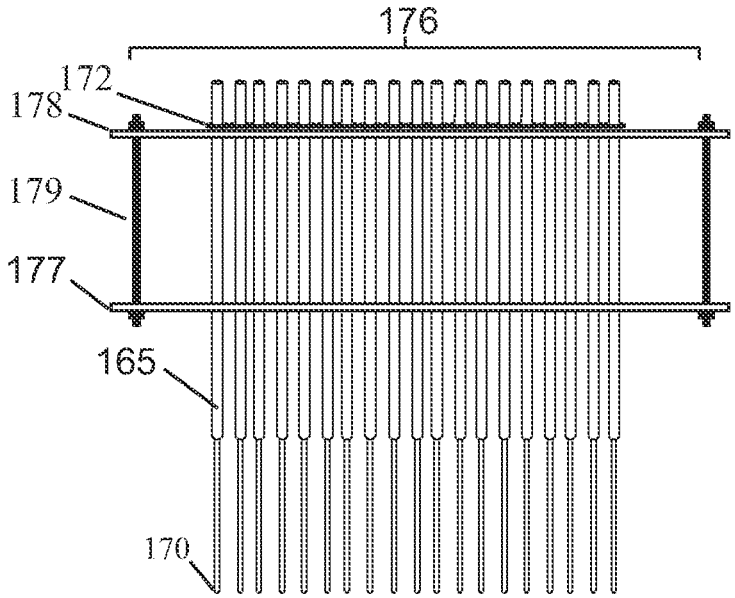
FIG. 11B is a side profile of thin tip tamper rods placed inside a multi tamper frame forming a multi-tamper assembly in an embodiment of the present invention.
Figure 11C:
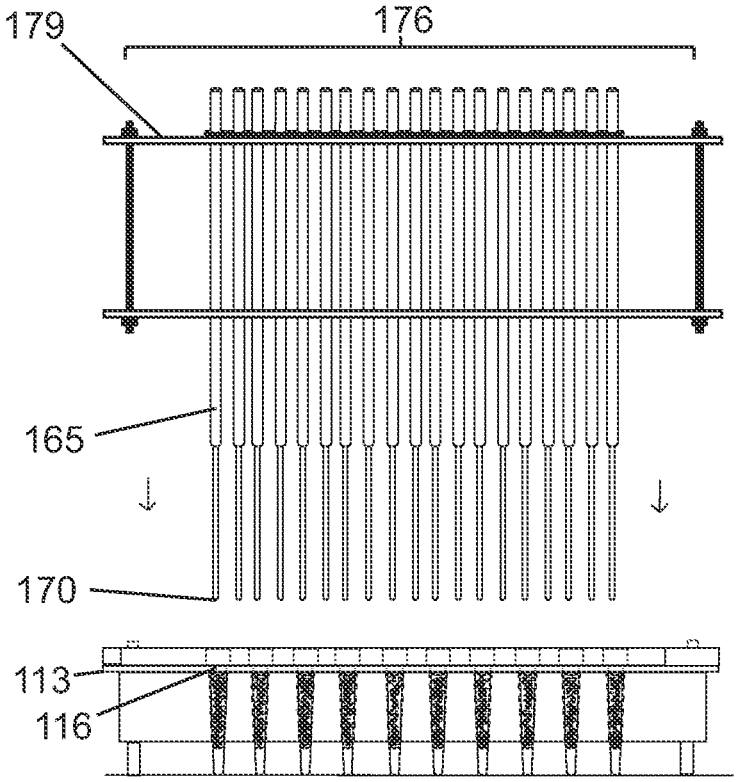
FIG. 11C is a side profile of multi-tamper assembly of FIG. 11B aligned with openings in the cover plate above the thick holder plate in an embodiment of the invention.

FIG. 11B illustrates a multi-tamper assembly 176, which is made up of a top plate 178 connected to spacer bars 179 which joins plate 178 and aligns it with a lower plate 177. Top plate 178 and lower plate 177 share a common hole pattern and spacing or thick holder plate 110 and cover plate 113. This feature aligns distal end 170 of the thin tip tamp rods 165 with the center of holes 116 of the cover plate 113. Thin tipped tamp rods 165 inserted into the holes in the top plate 178 and lower plate 177 are constrained by stop bands 172 to contact top plate 178. The tamp rods 165 are now in position to compress smoking material 120 inside paper cigarette roll 100. FIG. 11C illustrates multi-tamper assembly 176 positioned to align distal ends 170 of thin tip tamp rods 165 with the centers of holes 116 of cover plate 113. It is to be noted that the tamper rods are loosely held in the holes of plates 177 and 178. With the frame raised the tamper rods are supported on plate 178 by stop bands 172. Stop bands 172 are not connected or contacted between rods so each rod is independently supported.

Figure 12A:
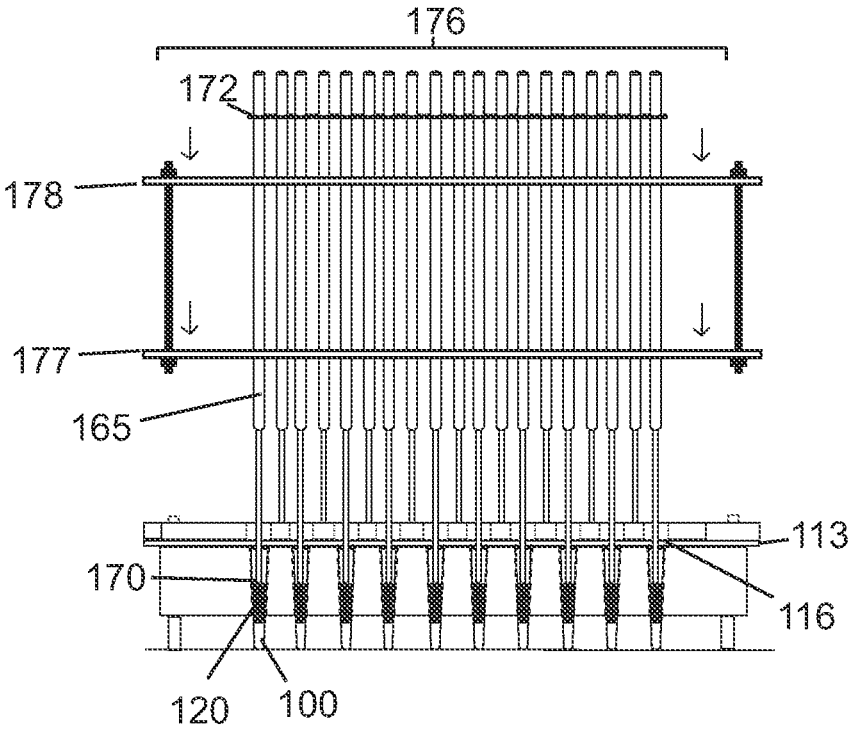
FIG. 12A is a side elevation view showing lowering of the multi-tamper assembly in an embodiment of the invention.

FIG. 12A illustrates lowering of multi-tamper assembly 176 until the distal thin tips 170 of the thin tip tamp rods 165 have passed through the holes 118 of corner keyhole fill tray 117 and holes 116 of cover plate 113 until the stop band is lifted from top plate 178 and the weight of each thin tip tamp rods 165 is transferred to the smoking material 120 in a paper roll, compressing the smoking material 120 inside the cigarette paper rolls 100. The weight of each tamper rod is now on the smoking material, and the rods are not supported by plate 178.

Figure 12B:
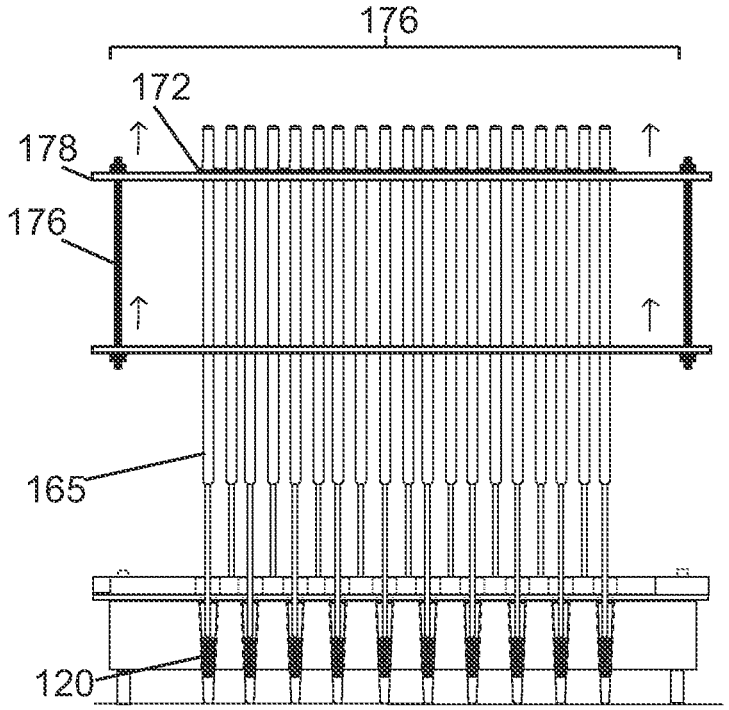
FIG. 12B is a side elevation view illustrating lifting of the multi-tamper frame in an embodiment of the invention.

FIG. 12B illustrates lifting of the multi-tamper assembly 176, which lifting is continued until top plate 178 contacts stop bands 172 of thin tip tamp rods 165, thus transferring the weight of the tamper rods 165 from smoking material 120 to top plate 178.

Figure 13A:
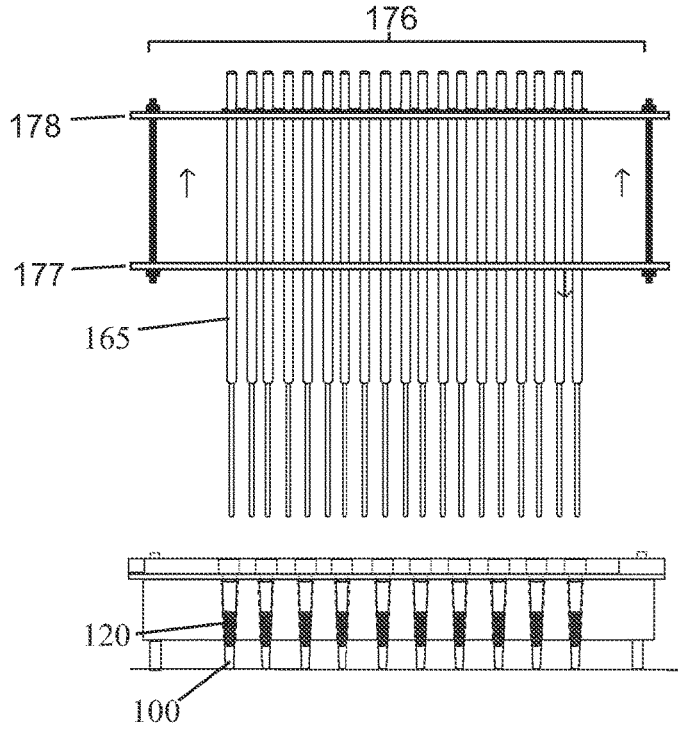
FIG. 13A is a side elevation illustrating lifting of the multi-tamper assembly upward until all thin tamping tip rods are clear of the corner keyhole fill tray holes.
Figure 13B:
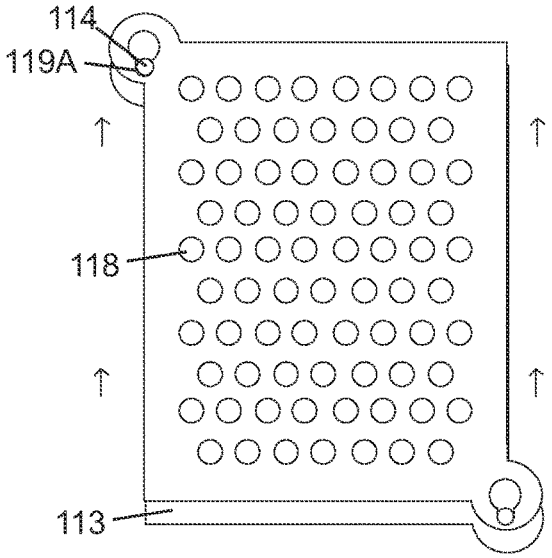
FIG. 13B is an overhead view illustrating movement of a corner keyhole fill tray back to closed position against alignment pegs.
Figure 13C:
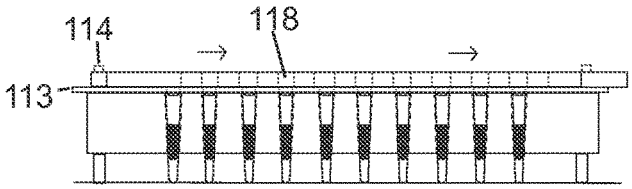
FIG. 13C is a side elevation of the movement of FIG. 13B.

FIG. 13A illustrates lifting of the multi-tamper assembly 176 until thin tipped tamper rods 165 have been lifted out of and away from cover plate 113, leaving behind compressed smoking material 120 in in cigarette paper rolls 100. FIG. 13B illustrates corner keyhole fill tray 117 shifted to the closed position, with cutout 119A tightly fitted around pegs 114. In this position, holes 118 stop above flat blank areas of the cover plate 113, hiding cover plate holes 116 and proximal end 102 of paper cigarette roll 100. Oversized holes 118 are now ready to be filled again with smoking material. FIG. 13C is a side elevation view.

Figure 14A:
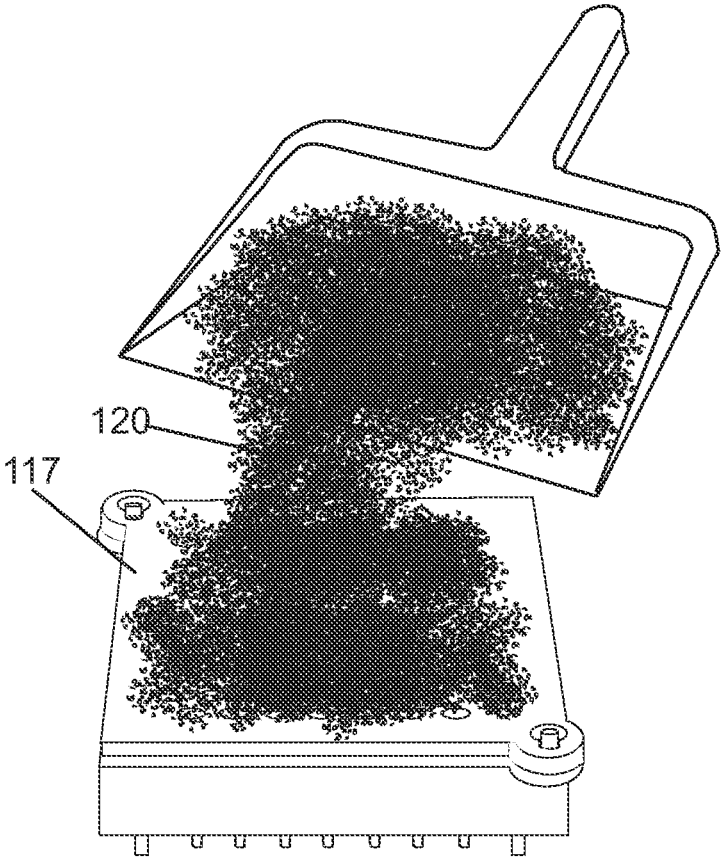
FIG. 14A is an overhead view illustrating milled smoking material again being poured into the holes of a corner keyhole fill tray.
Figure 14B:
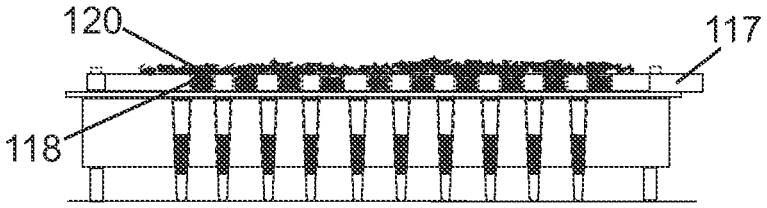
FIG. 14B is a side elevation of the operation of FIG. 14A.

FIG. 14A illustrates smoking material 120 being poured from a scoop onto corner keyhole fill tray 117 and into oversized holes 118 until resting on flat spaces of cover plate 113. FIG. 14B is a side profile view. Smoking material is added in this step ensuring each oversized hole 118 is completely full.

Figure 15A:
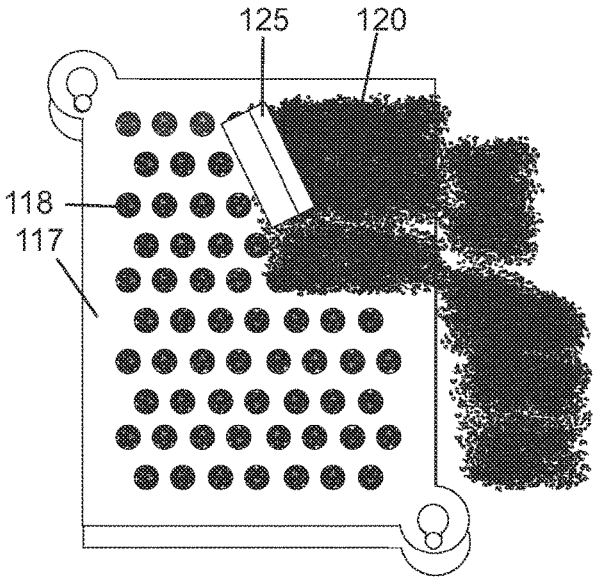
FIG. 15A is an overhead view illustrating a scraping tool removing excess smoking material from on the top of a corner keyhole fill tray.
Figure 15B:
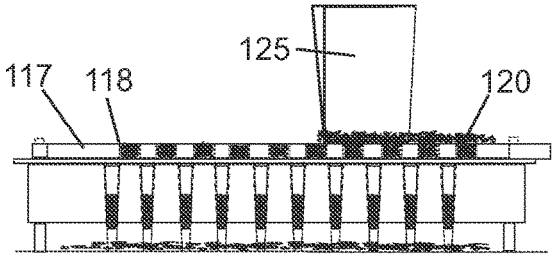
FIG. 15B is a side elevation view of the operation of FIG. 15A.
Figure 15C:
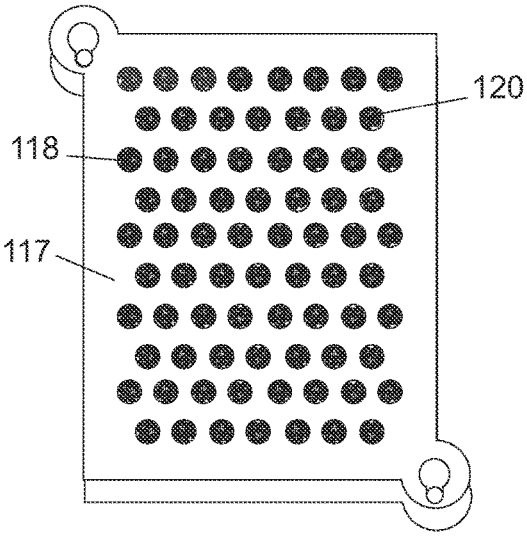
FIG. 15C is an overhead view illustrating smoking material filled into the holes of the corner keyhole fill tray.
Figure 15D:
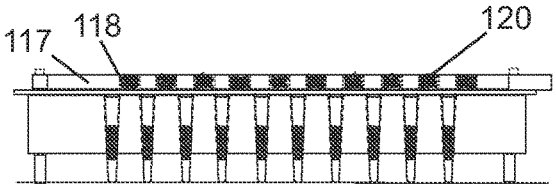
FIG. 15D is a side profile of the operation of FIG. 15C.

FIG. 15A illustrates flat scraping tool 125 removing all excess smoking material 120 from corner keyhole fill tray 117. FIG. 15B is a side elevation view. FIG. 15C illustrates oversized holes 118 completely filled with smoking material 120 and the top surface of corner keyhole fill tray 117 clean of excess smoking material. FIG. 15D is a side profile view.

Figure 16A:
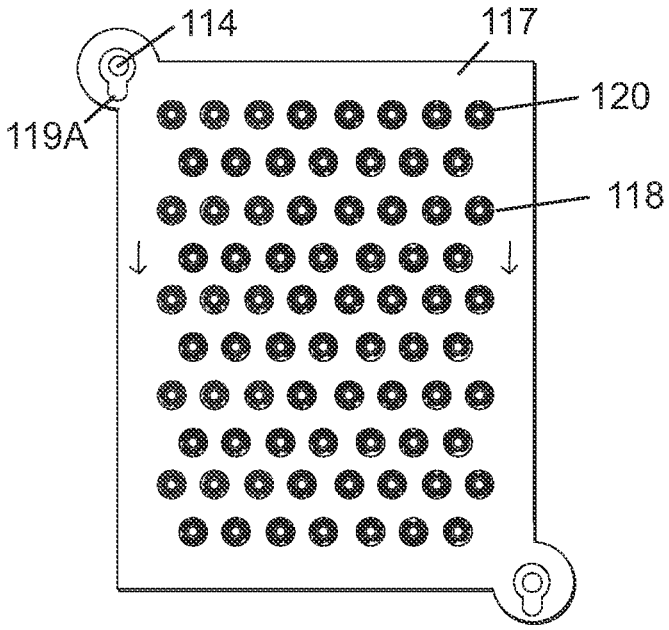
FIG. 16A is an overhead view illustrating movement of a corner keyhole fill tray to the center open position.
Figure 16B:
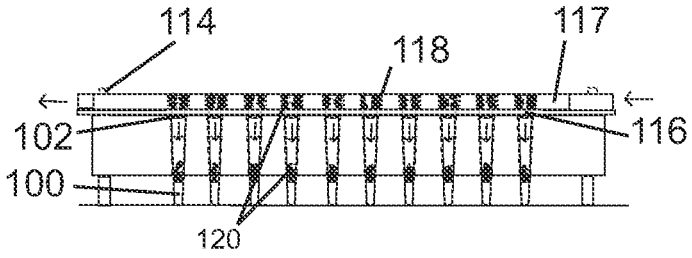
FIG. 16B is a side elevation view of the movement of FIG. 16A.
Figure 16C:
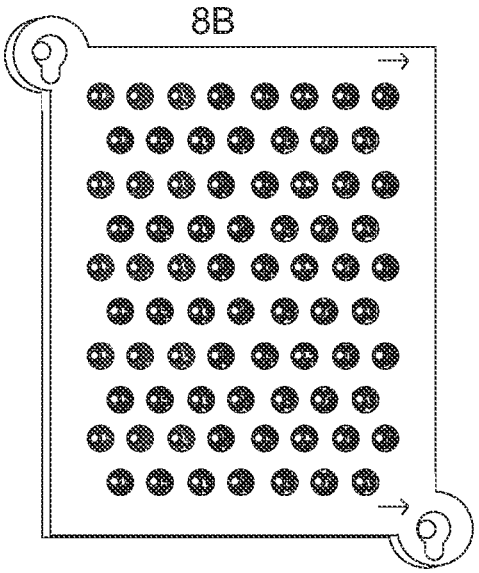
Figure 16D:
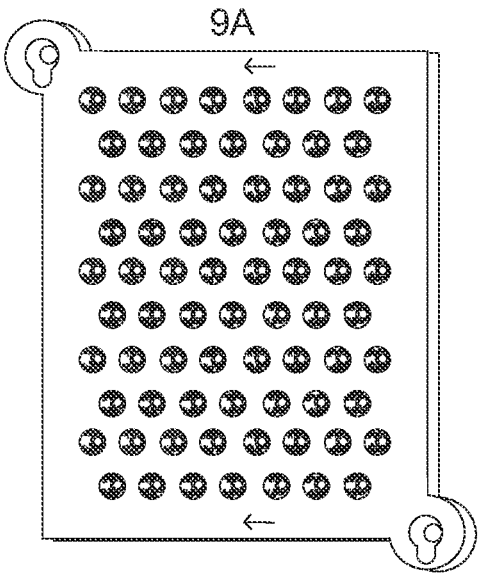
Figure 16E:
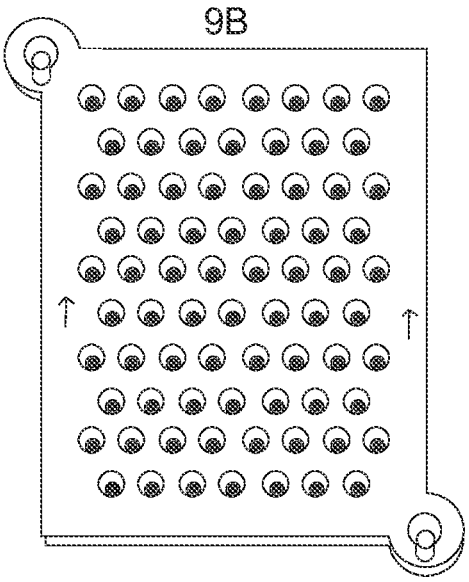
Figure 16F:
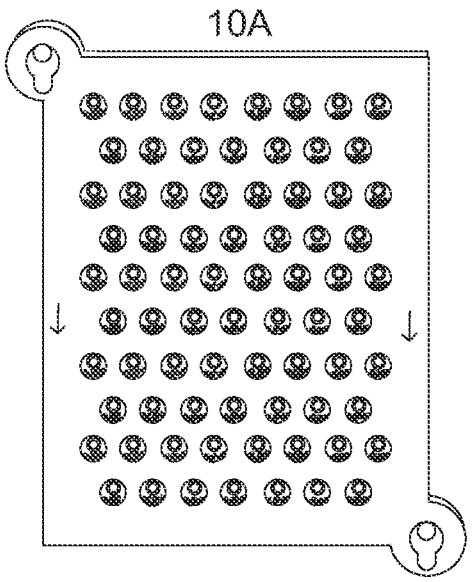

FIG. 16A illustrates movement of corner keyhole fill tray 117 again to the center open position disengaging pegs 114 from cutouts 119A. This operation allows some smoking material 120 to fall from the oversized hole 118 in corner keyhole fill tray 117 through the cover plate holes 116 into the opening in proximal end 102 of the cigarette paper rolls 100. FIG. 16B is a side elevation view.

FIGS. 16C, 16D, 16E and 16F illustrate repeating steps illustrated in FIGS. 8B, 9A, 9B, 10A in sequence until corner keyhole fill plate holes are emptied of smoking material, and the cigarette paper rolls 100 are now half full of uncompressed and half full of compressed smoking material 120.

FIG. 17A illustrates movement of corner keyhole fill tray 117 to the center position completely exposing cover plate holes 116 into the openings in proximal ends 102 of the cigarette paper rolls 100. In this centered position, the smoking material 120 is ready to be compressed. FIG. 17B is a side elevation view of this operation. FIG. 17C illustrates multi-tamper assembly 176 positioned to align distal end 170 of the thin tip tamper rods 165 with the centers of the holes 116 of the cover plate 113. FIG. 17D illustrates lowering of the multi-tamper assembly 176 until the distal skinny tips 170 of the thin tip tamper rods 165 have passed through the holes 116 of cover plate 113 and the stop bands are lifted from top plate 178 and the weight of the thin tip tamp rods 165 is transferred to the smoking material 120, compressing the smoking material 120 inside the cigarette paper rolls 100.xxxx FIG. 18A illustrates beginning lifting of the multi-tamper assembly 176 until top plate 178 contacts stop bands 172 of the thin tip tamper rods, thus transferring the weight of rods 165 from smoking material 120 to top plate 178. FIG. 18B illustrates continuing lifting of the multi-tamper assembly 176 until the thin tip tamper rods have been lifted out of and away from cover plate 113, leaving behind compressed smoking material 120 in in cigarette paper rolls 100.

FIG. 18C illustrates removal of corner keyhole fill tray 117 from above cover plate 113. Note that cigarette paper roll 100 is now nearly filled to proximal end 102 with compressed smoking material 120.

FIG. 19A illustrates smoking material 120 being poured from a scoop onto cover plate 113 into holes 116 and into openings at proximal end 102 of paper cigarette rolls 100 ensuring each cover plate hole 116 is completely full. FIG. 19B is a side elevation view. FIG. 19C illustrates flat scraping tool 125 removing excess smoking material 120 from cover plate 113 that hasn't fallen into holes 116.

FIG. 20A is a side elevation view illustrating cover plate 113 clear of smoking material. Fig. Note at this stage the remaining smoking material inside paper cigarette roll 100 and the hole 116 in cover plate 113 is ready to be compressed. FIG. 20B illustrates a straight tamper rod 185, according to an embodiment of the invention. The straight tamper rod 185 may be used to compress smoking material 120 or the like inside the proximal ends 102 of cigarette paper rolls 100. Straight tamper rod 185 is a solid elongated cylindrical steel tube having closed ends, namely distal end 180 and proximal end 181. Distal end 180 is a flat end used to compress smoking material 120. Proximal end 181 includes a stop band 182. Stop band 182 is used to stop straight tamper rod 185 from sliding all the way through the holes in a multi-tamper assembly 176 illustrated in FIG. 20C, made up of top plate 178 which is connected to spacer bars 179 which joins it to and aligns it with lower plate 177. Top plate 178 and lower plate 177 share the same hole pattern and spacing as thick holder plate 110 and cover plate 113. This feature aligns distal end 180 of straight tamp rods 185 with the center of hole 116 of the cover plate 113. Straight tamp rods 185 may be inserted into the holes in the top plate 178 and lower plate 177 until stop bands 182 contacts top plate 178. The tamper rods 185 are now in position to compress smoking material 120 inside paper cigarette rolls 100.

FIG. 21A illustrates multi tamper assembly 176 positioned to align distal end 180 of the wide tamp rods 185 with the centers of the holes 116 of the cover plate 113. FIG. 21B illustrates lowering of the assembly 176 until the distal ends 180 of the straight tamp rods 185 have passed through the holes 116 of cover plate 113, the stop band 182 is lifted from top plate 178 and the weight of the wide tamp rods 185 is transferred to the smoking material 120, compressing the smoking material 120 inside the cigarette paper rolls 100 and smoking material within holes 116 of cover plate 113.

FIG. 22A illustrates lifting of the multi-tamper assembly 176 until top plate 178 contacts stop band 182 of straight tamp rod 185, thus transferring the weight of straight tamp rod 185 from smoking material 120 to top plate 178. The multi-tamper assembly 176 continues to be lifted until straight tamper rod 185 has been lifted out of and away from cover plate 113, leaving behind compressed smoking material 120 in in cigarette paper rolls 100 and the holes 116 of cover plate 113. If necessary, the actions of FIGS. 19A, 19B, 20A, 21A, 21B, 22A may be repeated in sequence until smoking material 120 completely fills paper cigarette roll 100 and the space inside hole 116 of cover plate 113.

FIG. 22B illustrates removal of cover plate 113 from thick holder plate 110. Note that cigarette paper rolls 100 are now completely filled to and slightly above the top proximal end 102 with compressed smoking material 120.

FIG. 23A illustrates flat scraping tool 125 removing all excess smoking material 120 from above proximal end 102 of cigarette paper roll 100 and off of the top of thick holder plate 110. FIG. 23B illustrates thick holder plate 110 filled with cigarette paper rolls 100 now completely full of compressed smoking material 120 to proximal end 102.

FIG. 24A illustrates multi-tamper assembly 176 aligned with the proximal openings at end 102 of the paper cigarette rolls 100 and compressed smoking herbs 120. FIG. 24B is a front angle view of this operation. FIG. 24C illustrates lowering of the multi-tamper assembly 176 until the weight of the straight rods 185 is transferred to the compressed smoking material 120 inside the paper cigarette roll 100, compressing any of the remaining smoking material to the top of the thick holder plate 110 and proximal end 102, ensuring the smoking material is well compressed and not likely to fall out. FIG. 24D shows a front angle view of this operation.

FIG. 25A illustrates lifting of the multi-tamper assembly until top plate 178 contacts stop bands 182 of straight tamper rods 185, thus transferring the weight of straight tamper rods 185 from smoking material 120 to top plate 178. The multi-tamper assembly 176 continues to be lifted until straight tamper rods 185 have been lifted out of and away from compressed smoking material 120 in in cigarette paper rolls 100. FIG. 25B is a side profile illustrating paper cigarette rolls 100 completely filled with compressed smoking material 120 inside holes 111 of the thick holder plate 110.

FIG. 26A illustrates a spinning burnishing rod 200, which is similar to straight tamp rod 185, as a solid elongated cylindrical steel tube having closed ends, namely distal end 201 and proximal end 202. Distal end 201 includes a flat smooth end that spins and burnishes the compressed smoking material. Proximal end 201 includes a gear 205, used to spin burnishing rod 200. FIG. 26B illustrates spinning burnishing rods 200 with gears 205 creating a spinning rod assembly 196. To create the spinning motion of rods 200, a drive motor 210 is mounted to top plate 178 and turns a drive gear 206. Drive gear 206 turns gears 205 meshed with other gears 205 to transfer spinning motion from one spinning burnishing rod 200 to others, needing only one drive motor 210 to drive many gears 205, thus spinning many rods 200. Gears 205 rest on top plate 178 allowing them to move up and down slightly while keeping the gear teeth engaged. FIG. 26C is an overhead view of the spinning rod assembly.

FIG. 27A illustrates an enlarged view of positioning of the flat surface of distal end 201 of spinning burnishing rod 200 above the opening at proximal end 102 of the paper cigarette rolls 100 completely filled with compressed but unburnished smoking material 120 inside holes 111 of the thick holder plate 110. FIG. 27B illustrates an enlarged view of pressing of the flat surface of distal end 201 of spinning burnishing rod 200 onto the opening at proximal end 102 of the paper cigarette rolls 100, burnishing the smoking material 120 at opening of proximal end 102 of cigarette paper rolls 100 inside holes 111 of the thick holder plate 110. FIG. 27C illustrates an enlarged view of the flat surface of distal end 201 of spinning burnishing rod 200 lifted away from the opening at proximal end 102 of the paper cigarette rolls 100, leaving behind a smooth and burnished surface of smoking material 120 at the opening at proximal end 102 of cigarette paper roll 100.

FIG. 28A is a side profile view of an ejection block 190. FIG. 28B illustrates positioning of thick holder plate 110 filled with paper cigarette rolls 100 filled with compressed smoking material 120 ready to be lowered onto the ejection block 190.

FIG. 29A illustrates thick holder plate 110 lowered onto the ejection block 190, which pushes against the distal end 101 of the paper cigarette rolls 100 filled with compressed smoking material upward out of holes 111 of thick holder plate 110. FIG. 29B illustrates complete removal of the completed paper cigarette rolls 100 completely filled with compressed smoking material 120 from resting on ejection plate 180 and from inside holes 111 of the thick holder plate 110. Now the cigarette paper rolls 100 are completely filled with smoking material 120 representing a finished product ready for packaging or consumption.

FIG. 30 is a flow diagram depicting a step-by-step method in an embodiment of the invention for filling paper rolls with smoking material, compressing the smoking material in the paper rolls, burnishing the smoking material compressed in the paper rolls, and removing finished cigarettes at the end of the process.

At step 3001 cigarette paper rolls are placed in holes in a holder plate resting on lifter pegs. At step 3002 a cover plate is placed over the holder plate, positioned by alignment pegs near the corners of the holder plate. At step 3003 a corner keyhole fill tray is placed over the cover plate over the alignment pegs. At step 3004 the corner keyhole fill tray is moved to a closed position.

At step 3005 smoking material is poured over the fill tray and into the holes in the fill tray. At step 3006 excess material is scraped from the top of the fill tray, leaving the holes full of smoking material. At step 3007 the fill tray is moved laterally to a series of different positions dropping material from the holes in the fill tray into the paper rolls held in the holder plate. At step 3008 an assembly of thin tipped tamper rods, one for each paper roll, is positioned over the paper rolls in the holder plate. At step 3009 the assembly of tamper rods is lowered until the tamper rods contact the smoking material in the paper rolls and the weight of the tamper rods is transferred to the smoking material. At step 3010 the assembly is raised transferring the weight of the tamper rods back to the assembly.

At step 3011 steps 3005 through 3011 are repeated. This repetition may be made once, or more than once. At step 3012 smoking material is again poured onto the fill tray in excess. At step 3013 an assembly of straight tamper rods are employed to further compress the material in the paper rolls. At step 3014 the cover plate is removed from the holder plate. Excess material is scraped from the top of the holder plate in step 3015. At step 3016 the assembly of straight tamper rods is used again to further compress the smoking material in the paper rolls. At step 3017 a motor-driven assembly of burnishing rods is used to burnish the ends of the compacted smoking material in the paper rolls. And finally, at step 3018 the holder plate is placed on an ejection block and the finished cigarettes are ejected out the top of the holder plate.

The skilled artisan will understand that there may be alterations in the steps of the process within the scope of the invention.

It will be apparent to the skilled artisan that the embodiments illustrated and described in this application are exemplary in nature, and not limiting to the scope of the invention. There are many variations in the embodiments that may also be within the scope of the invention, which scope is limited only by the claims.

The invention claimed is:

1. An apparatus for making cigarettes, comprising:

a holder plate having a matrix of vertically oriented first holes adapted for holding cigarette paper rolls having a filter on a first end and open at a second end, the holder plate resting on lifter pegs on a support surface, such that a paper roll in a hole in the holder plate has the open end up and the filter end proximate the support surface;

a cover plate substantially thinner than the holder plate, having a matrix of second holes matching the matrix of holes in the holder plate, the cover plate engaging alignment pegs in a top surface of the holder plate, aligning the matrix of second holes with the matrix of first holes; and a fill tray having a matrix of third holes matching the matrix of second holes in the cover plate, the third holes having a common diameter larger than the diameter of the second holes in the cover plate, the fill tray having a thickness greater than the thickness of the cover plate and two keyhole corner openings adapted to engage the alignment pegs of the holder plate in a manner allowing a range of lateral positions of the fill tray relative to the cover plate;

characterized in that one of the lateral positions of the fill tray is a closed position with no passage between the third holes in the fill tray and the second holes in the cover plate, enabling a volume of smoking material determined by a diameter of the third holes and the thickness of the fill tray to be placed in the third holes, and in that another of the lateral positions is an open position with the third holes aligned with the second holes, wherein moving the fill tray having third holes filled with smoking material from the closed position to the open position allows the smoking material in the third holes to fall through the second holes in the cover plate into the paper rolls in the first holes of the holder plate.

2. The apparatus of claim 1 wherein the keyhole corner openings are on two diagonally opposite corners of the fill tray.

3. The apparatus of claim 1 wherein the open ends of the paper rolls have an inside diameter and the second holes of the cover plate have a diameter equal to the inside diameter of the open end of the paper rolls.

4. The apparatus of claim 1 wherein the keyhole corner openings in the fill tray each comprise a round hole of a diameter greater than the diameter of the third holes in the fill tray, with a half round slot to one side that when firmly engaged to the alignment pegs places the fill tray in the closed position.

5. The apparatus of claim 4 wherein with the fill tray placed such that the alignment pegs are in any position other than engaged in the half round slot, there is at least a partial passage between the third holes in the fill tray and the second holes in the cover plate.

6. The apparatus of claim 1 further comprising a scoop for pouring smoking material onto the fill tray and into the third holes and a scraper for scraping excess smoking material from a top surface of the fill tray.

7. The apparatus of claim 1 further comprising a plurality of thin tipped tamper rods supported by stop bands in a matrix of openings in a set of plates in a first frame, the matrix of openings in the plates matching the matrix of second holes in the cover plate, in a manner that each thin-tipped tamper rod is loosely supported and separate from every other thin-tipped tamper rod, the first frame adapted to be positioned over the fill tray such that the thin-tipped tamper rods align with the third holes in the fill tray.

8. The apparatus of claim 1 further comprising a plurality of straight tamper rods supported by stop bands in a matrix of openings in a set of plates in a second frame, the matrix of openings in the plates matching the matrix of second holes in the cover plate, in a manner that each straight tamper rod is loosely supported and separate from every other straight tamper rod, the second frame adapted to be positioned over the fill tray such that the straight tamper rods align with the third holes in the fill tray.

9. The apparatus of claim 1 further comprising a plurality of burnishing rods supported in a matrix of openings in a set of plates in a third frame, the matrix of openings in the plates matching the matrix of second holes in the cover plate, in a manner that each burnishing rod is loosely supported and separate from every other burnishing rod, the third frame adapted to be positioned over the fill tray such that the burnishing rods align with the third holes in the fill tray, wherein the burnishing rods are driven by an electric motor.

10. The apparatus of claim 1 further comprising an ejector plate having a width and a length greater than the dimensions of the matrix of holes in the holder plate and less than the separation between the lifter pegs on the bottom of the holder plate, the ejector plate having a thickness substantially a length of the lifter pegs.

11. A method for making cigarettes using the apparatus of claim 1, comprising the steps of:

placing the holder plate on the support surface on lifter pegs;

placing paper rolls in the holes in the holder plate;

placing the cover plate over the holder plate, with the cover plate engaging the alignment pegs in the top surface of the holder plate;

placing the fill tray over the cover plate;

completing steps for filling comprising the steps of:

moving the fill tray to a closed position;

pouring smoking material onto the fill tray and into the holes in the fill tray;

scraping off excess smoking material;

moving the fill tray to a position at least partially open allowing smoking material to fall into the paper rolls;

positioning a first frame supporting thin-tipped tamper rods over the fill tray, aligning the thin-tipped tamper rods with the holes in the cover plate;

lowering the first frame tamping the smoking material in the paper rolls;

repeating the steps for filling moving the fill tray to a closed position with no passage between the third holes in the fill tray and the second holes in the cover plate, pouring smoking material onto the fill tray and into the holes in the fill tray, scraping off excess smoking material, moving the fill tray to a position at least partially open allowing smoking material to fall into the paper rolls, positioning the first frame supporting thin-tipped tamper rods over the fill tray, aligning the thin-tipped tamper rods with the holes in the cover plate, and lowering the first frame tamping the smoking material in the paper rolls;

pouring smoking material onto fill tray in excess;

positioning a second frame supporting straight tamper rods over the fill tray, aligning the straight tamper rods with the holes in the cover plate;

lowering the second frame tamping the smoking material in the paper rolls;

removing the cover plate;

positioning the second frame supporting straight tamper rods over the fill tray, aligning the straight tamper rods with the holes in the cover plate;

lowering the second frame tamping the smoking material in the paper rolls;

positioning an assembly of motor-driven burnishing rods over the holder plate;

lowering the assembly of burnishing rods to burnish ends of the smoking material in the paper rolls; and placing the fill tray over an ejection block, ejecting finished cigarettes from the holder plate.

* * * * *